US007272348B2

(12) United States Patent
Okamoto et al.

(10) Patent No.: US 7,272,348 B2
(45) Date of Patent: Sep. 18, 2007

(54) DEVELOPING METHOD USING A DEVELOPER WITH A SPECIFIED DEGREE OF COMPRESSION AND SHEARING STRESS

(75) Inventors: Naoki Okamoto, Mishima (JP); Hiroyuki Fujikawa, Yokohama (JP); Koh Ishigami, Mishima (JP); Nobuyoshi Sugahara, Toride (JP); Yoshinobu Baba, Yokohama (JP); Takayuki Itakura, Mishima (JP)

(73) Assignee: Canon Kabushiki Kaisha, Tokyo (JP)

( * ) Notice: Subject to any disclaimer, the term of this patent is extended or adjusted under 35 U.S.C. 154(b) by 267 days.

(21) Appl. No.: 11/114,080

(22) Filed: Apr. 26, 2005

(65) Prior Publication Data

US 2005/0238392 A1 Oct. 27, 2005

(30) Foreign Application Priority Data

Apr. 27, 2004 (JP) ..... 2004-131124

(51) Int. Cl.
*G03G 15/09* (2006.01)

(52) U.S. Cl. ..... 399/269; 430/111.4

(58) Field of Classification Search ..... 399/267, 399/269, 274, 276, 277; 430/111.35, 111.4, 430/122

See application file for complete search history.

(56) References Cited

U.S. PATENT DOCUMENTS

| | | | | |
|---|---|---|---|---|
| 6,077,635 | A | 6/2000 | Okado et al. | 430/45 |
| 6,122,473 | A | 9/2000 | Goseki et al. | 399/286 |
| 6,137,977 | A | 10/2000 | Okado et al. | 399/252 |
| 6,383,704 | B1 * | 5/2002 | Kataoka et al. | 430/108.6 |
| 6,391,511 | B1 | 5/2002 | Okamoto et al. | 430/120 |
| 6,687,476 | B2 | 2/2004 | Goseki et al. | 399/109 |
| 6,873,816 | B2 | 3/2005 | Akashi et al. | 399/286 |
| 6,973,281 | B2 | 12/2005 | Hirobe et al. | 399/269 |
| 7,054,583 | B2 * | 5/2006 | Hirobe | 399/269 |
| 7,054,584 | B2 * | 5/2006 | Hirobe | 399/269 |
| 7,099,609 | B2 * | 8/2006 | Hirobe et al. | 399/269 |
| 2003/0152857 | A1 | 8/2003 | Sugiura et al. | 430/109.2 |
| 2004/0022560 | A1 | 2/2004 | Hirobe et al. | 399/269 |
| 2005/0048269 | A1 | 3/2005 | Shimamura et al. | 428/195.1 |
| 2005/0095038 | A1 | 5/2005 | Okamoto et al. | 399/276 |
| 2005/0244195 | A1 | 11/2005 | Hirobe et al. | 399/269 |

FOREIGN PATENT DOCUMENTS

| | | |
|---|---|---|
| EP | 1 319 992 A1 | 6/2003 |
| EP | 1 357 443 A2 | 10/2003 |

(Continued)

*Primary Examiner*—William J. Royer
(74) *Attorney, Agent, or Firm*—Fitzpatrick, Cella, Harper & Scinto

(57) ABSTRACT

A developing method using a developing device including at least: a first developer bearing member arranged to be opposed to an image bearing member; and a second developer bearing member arranged on a downstream side of a rotation direction of the image bearing member with respect to the first developer bearing member, the developing method including developing a latent image formed on the image bearing member with a developer, in which: the developer is a two-component developer having toner and a magnetic carrier; and the developer has a degree of compression C in the range of 20 to 32% and a shearing stress obtained by shearing stress measurement under a consolidation load of $4.0\times10^{-4}$ N/mm$^2$ in the range of $0.5\times10^{-4}$ to $2.5\times10^{-4}$ N/mm$^2$.

7 Claims, 3 Drawing Sheets

FOREIGN PATENT DOCUMENTS

| | | | |
|---|---|---|---|
| JP | 11073005 | A | 3/1999 |
| JP | 11-174731 | | 7/1999 |
| JP | 2003-295602 | | 10/2003 |
| JP | 2003-323043 | | 11/2003 |
| JP | 2003323052 | A | 11/2003 |

* cited by examiner

DEVELOPING METHOD USING A DEVELOPER WITH A SPECIFIED DEGREE OF COMPRESSION AND SHEARING STRESS

BACKGROUND OF THE INVENTION

1. Field of the Invention

The present invention relates to a developing method for developing an electrostatic latent image formed on an electrostatic latent image-bearing member such as an electrophotographic photoreceptor or an electrostatic recording derivative with a two-component developer for visualization in electrophotography.

2. Description of the Related Art

Although a large number of methods have been conventionally known as electrophotography, a general method involves: using a photoconductive substance to form an electrostatic latent image on an electrostatic latent image-bearing member (a photosensitive drum) by using various means; developing the electrostatic latent image with a developer (toner) for visualization; transferring the toner image onto a transfer material such as paper as required; and fixing the toner image onto the transfer material by virtue of heat, pressure, or the like to obtain a copy. Developing methods in electrophotography are mainly classified into a one-component developing method in which a carrier is not needed and a two-component developing method in which toner and a carrier are used. In particular, the two-component developing method is suitably used for a digital combination machine or a full-color copying machine where high image quality is required.

Known as the two-component developing method is the following method. The method involves: forming a magnetic brush of a two-component developer having nonmagnetic toner and a magnetic carrier on a developer bearing member (a developing sleeve) into which a magnet is incorporated; coating the carrier with the magnetic brush with a predetermined thickness by means of a developer layer thickness regulating member; conveying the magnetic brush to a developing region opposed to a photosensitive drum; and bringing the magnetic brush close to/in contact with the surface of the photosensitive drum while applying a predetermined developing bias between the photosensitive drum and the developing sleeve in the developing region to visualize the electrostatic latent image as a toner image.

In recent digital combination machines and full-color copying machines each adopting the two-component developing method, in accordance with improved image quality and increased speed, a so-called multi-stage developing system has been widely proposed, in which development is performed by using multiple developer carries (developing sleeves) In the multi-stage developing system, the number of occasions of friction between a magnetic brush and the surface of a photosensitive drum is large, and a large developing region can be secured. Therefore, a high-definition and high-density image can be obtained, so the system has been preferably used. However, it is difficult to form a uniform developer layer on each of the multiple developing sleeves. In particular, if transportation of a developer between developing sleeves fails, scattering of the developer, uneven coating, or the like is apt to occur. In addition, stress to be applied to the developer between a developing sleeve and a developer layer thickness regulating member (between S and B) or between a developing sleeve and another developing sleeve (between S and S) is large, so deterioration of the developer is apt to occur. In consideration of those problems, it may be important to control the flowability of the developer.

With regard to the flowability of a two-component developer, JP 11-073005 A or JP 11-174731 A proposes a two-component developer characterized in that the two-component developer has an apparent density of 1.2 to 2.0 g/cm$^3$ and a degree of compression of 5 to 19%. Thus, in an image forming method in which a change in bulk density is suppressed and a change in permeability of a two-component developer is detected by using an inductance of a coil to control a toner concentration, the developer has a suppressing effect on fluctuations in image density and tint. However, in the multi-stage developing system, when such a two-component developer having flowability is used, it becomes difficult to form a uniform developer layer on each of the multiple developing sleeves, and, in particular, transportation of the developer between developing sleeves is apt to be nonuniform, so insufficient coating or the like may occur.

In addition, with regard to a multi-stage developing system using a two-component developer, for example, JP 2003-295602 A, JP 2003-323043 A, and JP 2003-323052 A each propose improvements of a magnetic pole structure, stirring means, and the like to form a uniform developer layer on a developing sleeve and to prevent deterioration of a developer in a developing unit. However, an improvement of a developer having flowability suitable for a multi-stage developing system still requires further investigation.

SUMMARY OF THE INVENTION

The present invention relates to a developing method using a developing device including a first developer bearing member arranged to be opposed to an image bearing member, and a second developer bearing member arranged on a downstream side of a rotation direction of the image bearing member with respect to the first developer bearing member. The developing method includes the developing steps of developing a latent image formed on the image bearing member with a developer. The developer is a two-component developer having toner and a magnetic carrier; and the developer has a degree of compression C in the range of 20 to 32%. The degree of compression is C (%)=100×(P−A)/P, where A represents an aerated bulk density (g/cm$^3$) and P represents a packed bulk density (g/cm$^3$). A shearing stress of the developer is obtained by shearing stress measurement under a consolidation load of $4.0\times10^{-4}$ N/mm$^2$ in the range of $0.5\times10^{-4}$ to $2.5\times10^{-4}$ N/mm$^2$.

DESCRIPTION OF THE PREFERRED EMBODIMENTS

Hereinafter, a best mode for carrying out the present invention will be described in detail.

First, the developing method of the present invention will be described in detail.

Figure 1:
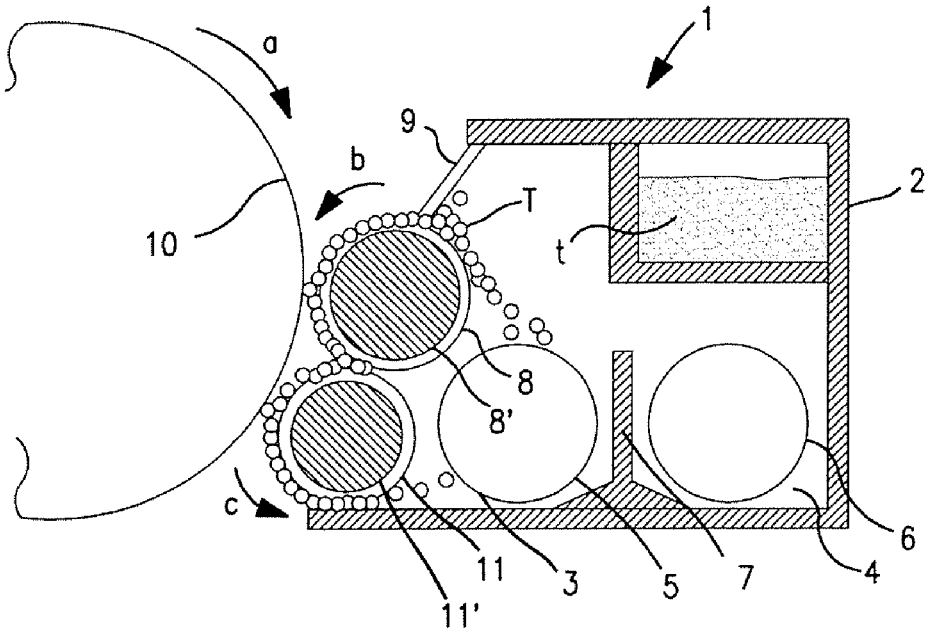
FIG. 1 is a schematic drawing showing an example of a developing device using a developing method of the present invention.

FIG. 1 shows an example of a developing device 1 using the developing method of the present invention. A developer T stored in a developer container 2 in the developing device 1 is carried and conveyed by a first developing sleeve 8 which is arranged on an upstream side of a rotation direction a of an image bearing member 10 and includes a first magnet roll 8' therein. Then, a developer layer is formed on the surface of the first developing sleeve 8 by a developer layer thickness regulating member 9 arranged so as to be close to the first developing sleeve 8. After that, the developer T is conveyed by the first developing sleeve 8 to a first developing region where the first developing sleeve 8 and the image bearing member 10 are opposed to each other, and is subjected to development. Then, the developer T remaining on the surface of the first developing sleeve 8 is transported to a second developing sleeve 11 arranged on a downstream side of the rotation direction a of the image bearing member 10 in a region where the first developing sleeve 8 and the second developing sleeve 11 are opposed to each other. The developer T transported to the second developing sleeve 11 is carried and conveyed by the second developing sleeve 11, and is conveyed to a second developing region where the second developing sleeve 11 and the image bearing member 10 are opposed to each other, followed by being subjected to development. After that, the developer T remaining on the surface of the second developing sleeve 11 is collected in the developer container 2.

In the case of such a developing method using a multi-stage developing system, a compressive force or a shearing force is applied to the developer T between the first developing sleeve 8 and the developer layer thickness regulating member 9 (between S and B) or between the first developing sleeve 8 and the second developing sleeve 11 (between S and S). In particular, in the case where the rotation direction of the first developing sleeve 8 is a direction b and the rotation direction of the second developing sleeve 11 is a direction c, a shearing force to be applied to the developer T between S and S is extremely large, so the developer T is apt to deteriorate. In view of the above, in order to alleviate stress to be applied to the developer T between S and B or between S and S, the inventors of the present invention have found that the above problem can be solved by using as a two-component developer a developer having:

a degree of compression C determined from the following equation (1) in the range of 20 to 32%:

$$\text{Degree of compression } C(\%)=100\times(P-A)/P \quad (1)$$

[where A represents an aerated bulk density (g/cm$^3$) and P represents a packed bulk density (g/cm$^3$)]; and a shearing stress by shearing stress measurement under a consolidation load of $4.0\times10^{-4}$ N/mm$^2$ in the range of $0.5\times10^{-4}$ to $2.5\times10^{-4}$ N/mm$^2$.

In the present invention, the degree of compression C of the developer according to flowability measurement is in the range of 20 to 32%. When the degree of compression is within the range, a napping state of the developer layer on the developing sleeve becomes uniform, and a charge amount distribution of toner on the developing sleeve becomes sharper. As a result, solid uniformity increases, and stress to be applied to the developer is alleviated, so the deterioration of the developer can be prevented.

When the degree of compression is less than 20%, stress to the developer is certainly alleviated, but the napping state of the developer becomes nonuniform. As a result, the charge amount distribution on the developing sleeve becomes broad, and uniformity of a solid image may reduce. In addition, it may be difficult to control the behavior of a particle between S and B or between S and S, so image quality may deteriorate or scattering of the developer may occur.

When the degree of compression C is larger than 32%, stress to the developer becomes so large that a compressed developer may reside or be packed between S and B or between S and S. As a result, a stripe, unevenness, or the like is apt to occur in the developer layer, or the accumulation of an external additive or toner spent on or to the carrier surface is apt to occur. Therefore, image quality deterioration due to the promotion of the deterioration of the developer is apt to occur.

In the present invention, a shearing stress of the developer obtained by shearing stress measurement is in the range of $0.5\times10^{-4}$ to $2.5\times10^{-4}$ N/mm$^2$ under a consolidation load of $4.0\times10^{-4}$ N/mm$^2$. When the shearing stress is within the range, the developer does not reside between S and B or between S and S even if a large shearing force is applied to the developer between S and B or between S and S, and hence the developing sleeve is uniformly coated with the developer. As a result, uneven coating of the developer layer on the developing sleeve and the deterioration of the developer are prevented, and a good image can be obtained for a long period of time.

When the shearing stress under a consolidation load of $4.0\times10^{-4}$ N/mm$^2$ is less than $0.5\times10^{-4}$ N/mm$^2$, the flowability of the developer is excessively good. As a result, when a shearing force is applied in the rotation direction of the developing sleeve, insufficient coating or the like resulting from insufficient regulation between S and B is apt to occur on the developing sleeve, and the scattering of the developer or the like is apt to occur at the time of transportation of the developer between S and S, which is responsible for image quality deterioration.

When the shearing stress of the developer under a consolidation load of $4.0\times10^{-4}$ N/mm$^2$ is larger than $2.5\times10^{-4}$ N/mm$^2$, the developer resides between S and B or between S and S even if a shearing force in the rotation direction of the developing sleeve is applied between S and B or between S and S. As a result, a stripe, unevenness, or the like may occur in the developer layer, or the developer may follow the rotation of the developing sleeve. Therefore, the accumulation of an external additive or toner spent on or to the carrier surface is apt to occur, so image quality deterioration due to the promotion of the deterioration of the developer is apt to occur.

Therefore, in the developing method, when the developer has a degree of compression C in the range of 20 to 32% and a shearing stress under a consolidation load of $4.0\times10^{-4}$ N/mm$^2$ in the range of $0.5\times10^{-4}$ to $2.5\times10^{-4}$ N/mm$^2$, the following effects are obtained. The developing sleeve is more uniformly coated with the developer layer and the charge amount distribution of toner becomes sharper. In addition, no residence of the developer occurs even if a compressive force or a shearing force is applied to the developer between S and B or between S and S, and stress to the developer is alleviated. As a result, no deterioration of the developer occurs, increased solid uniformity is maintained for a long period of time, and fluctuations in image density and triboelectrification can be suppressed. In the mode shown in FIG. 1, in order to facilitate the transportation of the developer between the developing sleeves 8 and 11, the magnetic pole of the first magnet roll 8' and that of a second magnet roll 11' incorporated into the second developing sleeve 11 are preferably opposite in polarity to each other.

In addition, in the developing device 1, the inside of the developer container 2 is partitioned into a developing chamber 3 and a stirring chamber 4 by a partition 7. A toner storage chamber is placed in an upper portion of the stirring chamber 4. Toner for replenishment is stored in the toner t storage chamber. The toner t corresponding to the amount of toner t consumed by development is dropped from a replenishment port placed at a toner storage chamber portion to replenish the stirring chamber 4 with the toner t. The developer T as a mixture of the toner t and a magnetic carrier is stored in each of the developing chamber 3 and the stirring chamber 4.

The developing chamber 3 includes a conveyance screw 5 which rotates to convey the developer T along a longitudinal direction of the first developing sleeve 8. The conveyance direction of the developer T by the conveyance screw 5 is opposite to that by a conveyance screw 6.

The partition 7 is provided with openings in front and back sides. The developer T conveyed by the conveyance screw 5 is transported to the conveyance screw 6 through one of the openings. Meanwhile, the developer T conveyed by the conveyance screw 6 is transported to the conveyance screw 5 thorough the other one of the openings.

Therefore, a circulating method is adopted, which involves: stirring and mixing the toner t with which the stirring chamber 4 is replenished and the developer T by using the conveyance screw 6; conveying the resultant developer T to the developing chamber 3 to subject the developer to development; and returning the developer T after the development to the stirring chamber 4 to replenish the chamber with toner t corresponding to the amount consumed by the development.

When such a circulating method is applied to the multistage developing system causing large stress to the developer as compared to a conventional developing system, the developing chamber for supplying the developer to the developing sleeve collects the developer that has passed through the developing region. Therefore, as the developer moves in the axial direction of the developing sleeve, the charge amount distribution of the toner on the developing sleeve changes, so solid uniformity in the axial direction may be impaired.

Figure 2:
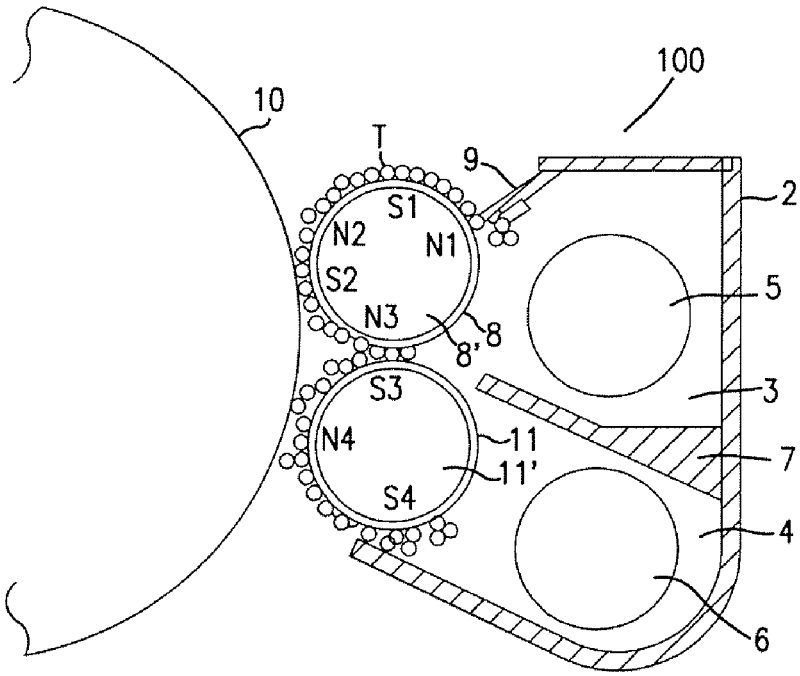
FIG. 2 is a schematic drawing showing an example of a developing device using the developing method of the present invention.

In view of the above, a developing device 100 shown in FIG. 2 is preferably used, in which functions are separated by the partition 7 into a developing chamber 3 for supplying a developer T to the first developing sleeve 8 and a stirring chamber 4 for collecting from a second developing sleeve 11 a developer T having passed through a developing region. In FIG. 2, an image bearing member 10 rotates in a clockwise direction and each of the first developing sleeve 8 and the second developing sleeve 11 rotates in a counterclockwise direction.

As a result, a fresh developer T is supplied from the developing chamber 3 to the first developing sleeve 8. In addition, toner supplied from a replenishment port (not shown) and a developer T having passed through the developing region are sufficiently stirred and mixed in the stirring chamber 4, and the mixture is supplied to the developing chamber 3 again.

In the developing device 100 shown in FIG. 2, the developing chamber 3 and the stirring chamber 4 are arranged in a vertical direction in a developer container 2. However, what is important is to achieve function separation into supply and collection of the developer T. The arrangement is not limited to that shown in FIG. 2. When the developing chamber 3 and the stirring chamber 4 are arranged in the vertical direction, the size of the developer container U2 can be advantageously reduced.

Figure 3:
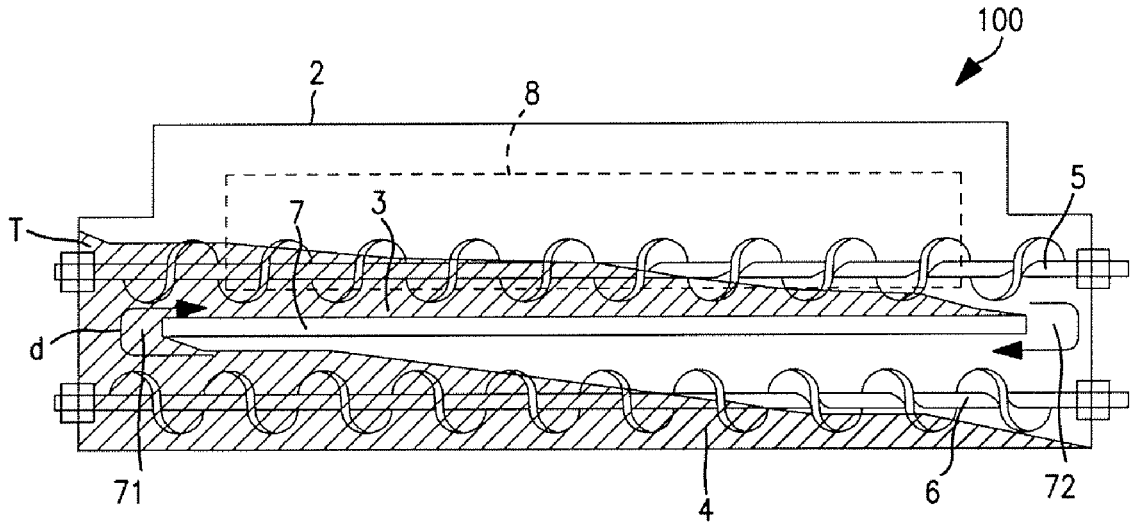
FIG. 3 is a schematic drawing showing an example of a developing device using the developing method of the present invention.

FIG. 3 shows an example of an existence state (state of an agent surface) of the developer T stored in the developer container 2. The circulation direction of the developer T is a direction d. In this case, the developer T is conveyed together with the developer T, which has passed through the developing region and has been collected from the second developing sleeve 11, to an opening portion 71 by a conveyance screw 6 in the stirring chamber 4, and is lifted and supplied to the developing chamber 3 at the opening portion 71. In addition, the lifted developer T is conveyed to an opening portion 72 by a conveyance screw 5 in the developing chamber 3 while being supplied by the first developing sleeve 8 in the developing chamber 3, followed by being dropped to the stirring chamber 4.

In the case of a developing method adopting such a circulating method, the following points should be noted. First, the agent surface of the developer T is lifted from the stirring chamber 4 to the developing chamber 3 at the opening portion 71 so that the developer T can be easily supplied. Second, the supplied developer T can be easily conveyed in the developing chamber 3.

In the present invention, when the developer has a degree of compression C in the range of 20 to 32% and a shearing stress under a consolidation load of $4.0\times10^{-4}$ N/mm$^2$ in the range of $0.5\times10^{-4}$ to $2.5\times10^{-4}$ N/mm$^2$, the developer is compressed to some extent. As a result, the agent surface can be easily lifted. In addition, conveyance property by a screw becomes good because the developer has an appropriate shearing stress. Therefore, excessive packing of the agent and insufficient circulation do not occur.

In addition, as shown in FIG. 2, it is preferable that: a first magnet roll 8' have a pole N3 on a downstream side of the developing region of the first developing sleeve 8; a pole N1 be arranged in the same moving direction so as to be adjacent to a downstream side of the pole N3; and a developer layer thickness regulating member 9 be arranged to be opposed to the pole N1. The transportation of the developer to the second developing sleeve 11 at the pole N3 becomes good owing to a repulsion magnetic field between the pole N1 and the pole N3. In addition, no magnetic pole is present between the pole N1 and the pole N3, so the developer T is not excessively taken and stress to the developer T between S and B can be alleviated.

In addition, it is preferable that a second magnet roll 11' have: a pole S3 at a position substantially opposed to the pole N3 of the first magnet roll 8' and having a polarity opposite to that of the pole N3; and a pole S4 arranged on an upstream side of the second developing sleeve 11 so as to be adjacent to the pole S3. Because the pole N3 of the first magnet roll 8' and the pole S3 of the second magnet roll 11' are opposite in polarity, the developer is prevented from following the rotation of the first developing sleeve 8', and the transportation of the developer T from the first developing sleeve 8 to the second developing sleeve 11 is performed better. In addition, the collection of the developer T from the second developing sleeve 11 to the stirring chamber 4 is performed more effectively owing to a repulsion magnetic field between the pole S3 and the pole S4. In addition, re-entry of the developer T into a space between S and S due to the phenomenon in which the developer T follows the rotation of the second developing sleeve 11 is prevented, so stress to the developer T between S and S can be further alleviated. Although it is particularly preferable to use a magnet roll having such a magnetic pole structure as described above, any magnetic pole structure of a magnet roll can be used without particular limitation as long as the structure can achieve the above object.

In addition, it is preferable that: the developing device of the present invention have a developer discharging mechanism; the developer discharging mechanism discharge an excessive developer; and the developing device be replenished with a developer for replenishment containing at least toner and a magnetic carrier. According to this replenishing method involving simultaneous replenishment with a magnetic carrier, the deterioration of charge imparting property of the magnetic carrier due to long-term duration can be further suppressed, and hence a good image can be stably obtained for a long period of time.

In addition, each of the developing sleeves 8 and 11 is preferably made of at least a material such as aluminum or nonmagnetic stainless steel and preferably has an appropriate surface roughness on its surface. The surface roughness is preferably in the range of 0.1 to 4.0 μm in terms of an arithmetic mean roughness Ra of JIS-B-0601 or in the range of 1.0 to 40 μm in terms of a ten point height of irregularities. In addition, it is preferable to appropriately adjust the surface roughness in order to obtain a desired coating amount of a developer. Any one of the conventionally known methods can be applied to a method of imparting a roughness to the surface of a developing sleeve. However, dry blasting, a wet honing process, and the like by means of glass beads, alundum abrasive grains, and the like are preferably used.

Next, the magnetic carrier that can be used in the present invention will be described.

The magnetic carrier that can be used in the present invention is preferably a magnetic carrier obtained by forming a coating layer on the surface of each of conventionally known ferrite core particles or of a magnetic fine particle-dispersed resin core. The magnetic carrier is particularly preferably a magnetic carrier obtained by forming a coating layer on the surface of a magnetic fine particle-dispersed resin core (carrier core).

The magnetic carrier that can be used in the present invention preferably has a true density in the range of 2.5 to 5.0 g/cm$^3$, more preferably 2.5 to 4.2 g/cm$^3$, particularly preferably 3.0 to 4.0 g/cm$^3$. The true density of the magnetic carrier is preferably within the range because the scattering of the developer is suppressed and toner spent to the carrier is suppressed. The magnetic carrier is particularly preferably a magnetic carrier obtained by forming a coating layer on the surface of a magnetic fine particle-dispersed resin core because the true density can be easily adjusted to fall within the range.

In the magnetic carrier that can be used in the present invention, magnetic fine particles used for the magnetic fine particle-dispersed resin core are preferably magnetite fine particles. In addition, it is preferable to use fine particles of hematite ($\alpha$-$Fe_2O_3$), which is a nonmagnetic inorganic compound, in combination in order to adjust the true density and magnetic properties of the magnetic carrier.

A binder resin constituting a magnetic fine particle-dispersed resin core particle which can be used in the present invention is preferably a thermosetting resin.

Examples of the thermosetting resin include a phenol-based resin, an epoxy resin, a polyamide resin, a melamine resin, a urea resin, an unsaturated polyester resin, an alkyd resin, a xylene resin, an acetoguanamine resin, a furan resin, a silicone-based resin, a polyimide resin, and a urethane resin. Each of those resins maybe used alone, or two or more of them may be mixed. However, the mixture preferably contains a phenol resin.

A ratio between the binder resin and the magnetic fine particles constituting the core particles in the present invention (binder resin: magnetic fine particles) is preferably 1:99 to 1:50 on a mass basis.

In addition, in the present invention, a coating material for coating a carrier preferably contains at least a binder resin and a conductive fine particle.

Any one of the conventionally known resins can be used as the binder resin forming a coating material used for the magnetic carrier that can be used in the present invention. Preferable examples of such a resin include: perfluoropolymers such as polytetrafluoroethylene and polyperfluoropropylene; polyvinyl fluoride; polyvinylidene fluoride; polytrifluoroethylene; polyfluorochloroethylene; copolymers of vinylidene fluoride and acrylic monomers; copolymers of vinylidene fluoride and trifluorochloroethylene; copolymers of tetrafluoroethylene and hexafluoropropylene; copolymers of vinyl fluoride and vinylidene fluoride; and copolymers of vinylidene fluoride and tetrafluoroethylene.

The binder resin forming the coating material particularly preferably used in the present invention is desirably a polymer or copolymer of (meth)acrylate having a perfluoroalkyl unit represented by the following general formula (A).

$$CF_3\text{-}(CF_2)_m\text{-} \quad (A)$$

[In the formula, m represents an integer of 0 to 10.]

Each of the above resins may be used alone, or two or more of them may be mixed before use. In addition, a thermoplastic resin may be mixed with a curing agent or the like for curing before use.

In the present invention, if m exceeds 10 in the above general formula, a resin is apt to precipitate from a solvent, so a good coating film is hardly obtained at the time of coating. m more preferably represents 5 to 9 in order to bring together good toner releasability and good coating film formability.

A resin represented by the following formula (B) is more preferably used because excellent adhesiveness with a core can be obtained.

$$CF_3\text{-}(CF_2)_m\text{-}(CH_2)_n\text{-} \quad (B)$$

[In the formula, m represents an integer of 0 to 10 and n represents an integer of 1 to 10.]

Furthermore, a resin having a unit represented by the following general formula (C) and an acrylate unit or methacrylate unit represented by the following general formula (D) is preferable for improving toner releasability from the carrier.

(C)

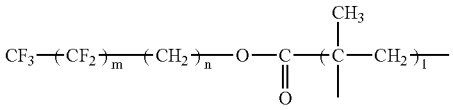

[In the formula, m represents an integer of 0 to 10, n represents an integer of 1 to 10, and 1 represents an integer of 1 or more.]

(D)

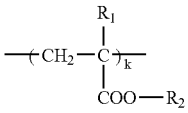

[In the formula, $R_1$ represents a hydrogen atom or a methyl group, $R_2$ represents a hydrogen atom or an alkyl group having 1 to 20 carbon atoms, and k represents an integer of 1 or more.]

A resin obtained by grafting the polymer having the unit represented by the general formula (D) on the copolymerization unit of the unit represented by the general formula (C) and the unit represented by the general formula (D) is particularly preferable because toner releasability can be maintained even after long-term use and resistance to peeling of a coating material from a carrier is excellent.

When a thermoplastic resin is used as the binder resin forming the coating material, the thermoplastic resin preferably has a weight average molecular weight in the range of 10,000 to 300,000 in gel permeation chromatography (GPC) of tetrahydrofuran (THF) soluble matter for improving the strength of the coating material and resistance to peeling of the coating material from the core surface.

The binder resin forming the coating material preferably has a main peak in the molecular weight range of 2,000 to 100,000 in GPC of THF soluble matter. The resin more preferably has a sub-peak or shoulder in the molecular weight range of 2,000 to 100,000. The resin most preferably has a main peak in the molecular weight range of 20,000 to 100,000 and a sub-peak or shoulder in the molecular weight range of 2,000 to 19,000 in GPC of THF soluble matter. When the molecular weight distribution is satisfied, development durability with which development can be performed on a large number of sheets by using toner having a small particle size, stability of charging to toner, and property of preventing an external agent from adhering to the carrier particle surface are further improved.

In the case where the resin forming the coating material is a graft copolymer, a backbone of the graft copolymer preferably has a weight average molecular weight in the range of 15,000 to 200,000 and a branch of the graft copolymer preferably has a weight average molecular weight in the range of 3,000 to 10,000. The weight average molecular weights can be adjusted by polymerization conditions for a backbone portion of the graft copolymer and polymerization conditions for a branch portion of the graft copolymer.

In the present invention, a resin having a graft copolymer is preferably used as the coating material The carrier core is particularly preferably coated with the coating material because resistance to peeling of the coating material from the core surface is excellent.

In addition, in the present invention, a silicone resin may be used as a resin for a coating material in terms of adhesiveness with a core and prevention of spent. The silicone resin may be used alone, or is preferably used in combination with a coupling agent in order to enhance the strength of a coating layer and to control charge to preferable one. Furthermore, part of the coupling agent is preferably used as a so-called primer agent with which the carrier core surface is to be treated prior to the coating with the resin. The use of the coupling agent as a primer agent results in the formation of a coating layer having a covalent bond to show improved adhesiveness.

Amino silane is preferably used as the coupling agent. When doing so, an amino group having positive chargeability can be introduced into the carrier surface and good negative charging property can be imparted to toner. Furthermore, in the case of a magnetic material-dispersed resin carrier, the presence of an amino group activates both a treating agent for imparting lipophilic property with which a metal compound is preferably treated and the silicone resin. Therefore, adhesiveness between the silicone resin and the carrier core is further enhanced, and the curing of the resin is simultaneously promoted. As a result, a strong coating layer can be formed.

The carrier core is preferably coated with the coating layer at a temperature of 30 to 80° C. under reduced pressure.

The reason for this is not clear, but is presumably any of the following.

(i) An appropriate reaction progresses at the time of coating and the carrier core surface is uniformly and smoothly coated with the coating material.

(ii) At a baking step, low temperature treatment at most 160° C. can be performed, excessive cross-linking of the resin is prevented, and durability of the resin layer can be enhanced.

A coating amount of a resin forming a coating material with respect to a carrier core is preferably 0.3 to 4.0 parts by mass, more preferably 0.4 to 3.5 parts by mass, or still more preferably 0.5 to 3.2 parts by mass with respect to 100 parts by mass of the carrier core.

When the coating amount is within the above range, good toner releasability can be obtained, and an image defect such as void hardly occurs. When the coating amount is less than 0.3 part by mass, the carrier core surface cannot be sufficiently coated, and an effect of the present invention cannot be exerted. On the other hand, when the coating amount exceeds 4.0 parts by mass, the carrier core surface cannot be uniformly coated at the time of coating, and charge-up may occur or the core surface may be exposed to cause toner spent at the portion. In addition, the specific resistance of the magnetic carrier may increase to cause an image defect such as void.

In addition, fine particles are preferably incorporated into the coating resin in order to make the shape of the carrier surface more uniform and/or to make the charge distribution of toner sharper.

Both organic and inorganic fine particles can be used as the fine particles. However, it is important to maintain the shapes of particles when the carrier core is coated. Therefore, cross-linking resin particles or inorganic fine particles are preferably used. Specific examples of a cross-linking resin include: cross-linking polymethylmethacrylate resins; cross-linking polystyrene resins; melamine resins; phenol resins; and nylon resins. Specific examples of the inorganic fine particles include fine particles of silica, titanium oxide, alumina, and the like. Each of them may be used alone, or two or more of them may be mixed before use. Of those, the cross-linking polymethylmethacrylate resins, the cross-linking polystyrene resins, and the melamine resins are preferable in terms of charging stability.

1 to 40 parts by mass of those fine particles are preferably incorporated into 100 parts by mass of the coating resin. When the fine particles are used in an amount within the range, charging stability and toner releasability become good, and an image defect such as void can be prevented. When the amount of the fine particles is less than 1 part by mass, an effect of the addition of the fine particles cannot be obtained. When the amount exceeds 40 parts by mass, the fine particles are apt to drop from the coating layer during duration, resulting in poor durability.

A peak value of the particle sizes of the fine particles is preferably in the range of 0.08 to 0.70 μm (more preferably in the range of 0.10 to 0.50 μm) on a number basis in order to obtain good toner releasability. When the peak value is less than 0.08 μm, it becomes difficult to disperse the fine particles into the coating material. When the peak value exceeds 0.70 μm, the fine particles drop from the coating layer during duration, resulting in poor durability.

In addition, conductive fine particles are preferably incorporated into the coating resin in order not to excessively lower the specific resistance of the carrier and in order to remove the charge remaining on the carrier surface.

Each of the conductive fine particles has a specific resistance of preferably $1\times10^8$ Ω·cm or less, or more preferably $1\times10^6$ Ω·cm or less. To be specific, particles containing at least one selected from carbon black, magnetite, graphite, titanium oxide, alumina, zinc oxide, and tin oxide are preferable. In particular, when carbon black is used as particles having conductivity, the addition of a small amount thereof can remove the charge remaining on the surface of the carrier. In addition, carbon black has a small particle size and does not interfere with irregularities of the carrier surface caused by fine particles. Therefore, carbon black can be preferably used. Carbon black has a peak value of a particle size in the range of preferably 10 to 60 nm (more preferably 15 to 50 nm) on a number basis in order to satisfactorily remove the charge remaining on the carrier surface and to satisfactorily prevent desorption from the carrier.

Carbon black to be used as conductive fine particles has a DBP oil absorption in the range of preferably 20 to 500 ml, more preferably 25 to 300 ml, or particularly preferably 30 to 200 ml with respect to 100 g of carbon black.

The DBP oil absorption is preferably within the range in order to efficiently remove the charge remaining on the carrier surface and to control the charging of the carrier. When the DBP oil absorption is less than 20 ml/100 g, carbon black has a short structure, so no efficient charge removal is performed and an effect of addition is hardly exerted.

1 to 15 parts by mass of those conductive fine particles are incorporated into 100 parts by mass of the coating resin in order not to excessively lower the specific resistance of the carrier and in order to remove the charge remaining on the carrier surface. When the amount of the conductive fine particles is less than 1 part by mass, a removing effect on the charge remaining on the carrier surface is hardly exerted. When the amount exceeds 15 parts by mass, the conductive fine particles are unstably dispersed into the coating material, and charge imparting property of the carrier itself may reduce owing to an excessive removing effect on charge.

The magnetic carrier that can be used in the present invention preferably has an average particle size on a number basis (D1) in the range of 10 to 80 μm. Particles having an average particle size of less than 10 μm are apt to adhere to the carrier. On the other hand, particles having an average particle size in excess of 80 μm each have a small specific surface area with respect to toner, so good charge impartation may not be achieved. In particular, in order to achieve high image quality and to prevent adhesion to the carrier, the magnetic carrier desirably has an average particle size in the range of 15 to 60 μm, or preferably in the range of 20 to 45 μm.

The number average particle size of the magnetic carrier can be calculated by: sampling 300 or more carrier particles each having a particle size of 0.1 μm or more at random by means of a scanning electron microscope (at a magnification of 100 to 5,000); measuring horizontal Feret's diameters of the carrier particles as carrier particle sizes by means of a digitizer; and averaging the carrier particle sizes.

The magnetic carrier that can be used in the present invention preferably has an intensity of magnetization (σ1000) in the range of 15 to 75 $Am^2/kg$ (emu/g) and a remnant magnetization (σr) of 7.5 $Am^2/kg$ or less measured in a magnetic field of $1{,}000\times(10^3/4\pi)$ A/m (1,000 Oe). When the intensity of magnetization (σ1000) exceeds 75 $Am^2/kg$, stress to the toner in a developer magnetic brush increases, the toner deteriorates, and spent to the carrier may be apt to occur. In addition, when the intensity of magnetization (σ1000) is less than 15 $Am^2/kg$, no magnetic binding force is exerted on the sleeve, adhesion to the carrier occurs, and the carrier may adhere to the surface of a photosensitive member to cause an image defect. In addition, when the remnant magnetization (σr) exceeds 7.5 $Am^2/kg$, insufficient flowability due to magnetic agglomeration may occur.

An example of a method of producing magnetic fine particle-dispersed resin core particles involves: mixing monomers of a binder resin and magnetic fine particles; and polymerizing the monomers to produce magnetic fine particle-dispersed resin core particles. Examples of the monomers that can be used for the polymerization include: vinyl-based monomers; bisphenols and epichlorohydrin for forming epoxy resins; phenols and aldehydes for forming phenol resins; urea and aldehydes for forming urea resins; and melamine and aldehydes. An example of a method of producing magnetic fine particle-dispersed core particles using a curing phenol resin involves: placing magnetic fine particles into an aqueous medium; and polymerizing phenols and aldehydes in the aqueous medium in the presence of a basic catalyst to produce magnetic fine particle-dispersed resin core particles.

Another method of producing magnetic fine particle-dispersed resin core particles involves: sufficiently mixing a vinyl-based or non-vinyl-based thermoplastic resin, a magnetic material, and any other additive by a mixer; melting and kneading the mixture by using a kneader such as a heating roll, a kneader, or an extruder; cooling the kneaded product; and pulverizing and classifying the cooled product to produce magnetic fine particle-dispersed core particles. At this time, the resultant magnetic fine particle-dispersed core particles are preferably thermally or mechanically spheroidized to be used as magnetic fine particle-dispersed core particles for the resin carrier. A thermosetting resin such as a phenol resin, a melamine resin, or an epoxy resin is preferable as the binder-resin because such a resin is excellent in durability, impact resistance, and heat resistance. The binder resin is more preferably a phenol resin in order that the characteristics of the present invention may be exerted more suitably.

Examples of the phenols for producing phenol resins include: phenol; alkylphenols such as m-cresol, p-tert-butylphenol, o-propylphenol, resorcinol, and bisphenol A; and compounds having phenolic hydroxyl groups such as halogenated phenols obtained by substituting benzene nuclei or alkyl groups in whole or in part by chlorine atoms or bromine atoms. Of those, phenol (hydroxybenzene) is more preferable.

Examples of the aldehydes for producing phenol resins include formaldehyde and furfural in the form of either formalin or paraldehyde. Of those, formaldehyde is particularly preferable.

A molar ratio of aldehydes to phenols is in the range of preferably 1 to 4, or more preferably 1.2 to 3. When the molar ratio of aldehydes to phenols is less than 1, particles are hardly produced or, if they are produced, the curing of the resin hardly progresses, so the intensity of each of the particles to be produced tends to be weak. On the other hand, when the molar ratio of aldehydes to phenols is larger than 4, the amount of unreacted aldehydes remaining in the aqueous medium remaining after the reaction tends to increase.

Examples of the basic catalyst used for condensation polymerization of phenols and aldehydes include those used for producing ordinary resol-type resins. Examples of such a basic catalyst include: ammonia water; and alkylamines such as hexamethylenetetramine, dimethylamine, diethyltriamine, and polyethyleneimine. A molar ratio of such a basic catalyst to phenols is preferably in the range of 0.02 to 0.3.

Next, toner to be used in the present invention will be described in detail.

First, a binder resin that can be used in the present invention will be described.

Any one of the conventionally known binder resins can be used in the present invention. However, a resin selected from (a) a polyester resin, (b) a hybrid resin having a polyester unit and a vinyl-based copolymer unit, (c) a mixture of a hybrid resin and a vinyl-based copolymer, (d) a mixture of a polyester resin and a vinyl-based copolymer, (e) a mixture of a hybrid resin and a polyester resin, and (f) a mixture of a polyester resin, a hybrid resin, and a vinyl-based copolymer is preferable.

When a polyester resin is used as the binder resin, a polyhydric alcohol, and a polyvalent carboxylic acid, a polyvalent carboxylic anhydride, a polyvalent carboxylate, or the like can be used as raw material monomers. The same holds true for a monomer used for producing a polyester unit in a hybrid resin.

Specific examples of a dihydric alcohol component include: alkyleneoxide adducts of bisphenol A such as polyoxypropylene(2.2)-2,2,-bis(4-hydroxyphenyl)propane, polyoxypropylene(3.3)-2,2,-bis(4-hydroxyphenyl)propane, polyoxyethylene(2.0)-2,2,-bis(4-hydroxyphenyl)propane, polyoxypropylene(2.0)-polyoxyethylene(2.0)-2,2,-bis(4-hydroxyphenyl)propane, and polyoxypropylene(6)-2,2,-bis(4-hydroxyphenyl)propane; ethylene glycol; diethylene glycol; triethylene glycol; 1,2-propylene glycol; 1,3-propylene glycol; 1,4-butanediol; neopentyl glycol; 1,4-butenediol; 1,5-pentanediol; 1,6-hexanediol; 1,4-cyclohexanedimethanol; dipropylene glycol; polyethylene glycol; polypropylene glycol; polytetramethylene glycol; bisphenol A; and hydrogenated bisphenol A.

Specific examples of an alcohol component which is trivalent or more include: sorbitol; 1,2,3,6-hexaenetetrol; 1,4-sorbitan; pentaerythritol; dipentaerythritol; tripentaerythritol; 1,2,4-butanetriol; 1,2,5-pentanetriol; glycerol; 2-methylpropanetriol; 2-methyl-1,2,4-butanetriol; trimethylolethane; trimethylolpropane; and 1,3,5-trihydroxymethylbenzene.

Examples of a divalent acid component include: aromatic dicarboxylic acids such as phthalic acid, isophthalic acid, and terephthalic acid, and anhydrides thereof; alkyldicarboxylic acids such as succinic acid, adipic acid, sebacic acid, and azelaic acid, and anhydrides thereof; succinic acid substituted by an alkyl group having 6 to 12 carbon atoms, and anhydrides thereof; and unsaturated dicarboxylic acids such as fumaric acid, maleic acid, and citraconic acid, and anhydrides thereof.

Examples of a polyvalent carboxylic acid which is trivalent or more for forming a polyester resin having a cross-linking site include 1,2,4-benzenetricarboxylic acid, 1,2,5-benzenetricarboxylic acid, 1,2,4-naphthalenetricarboxylic acid, 2,5,7-naphthalenetricarboxylic acid, 1,2,4,5-benzenetetracarboxylic acid, and anhydrides and ester compounds thereof.

Of those, in particular, a polyester resin obtained by condensation polymerization of: a bisphenol derivative typified by the following general formula (E) as a diol component; and a carboxylic acid component composed of a carboxylic acid which is divalent or more, an acid anhydride thereof, or a lower alkylester thereof (such as fumaric acid, maleic acid, maleic anhydride, phthalic acid, terephthalic acid, trimellitic acid, or pyromellitic acid) as an acid component is preferable because it has good charging property as color toner.

(E)

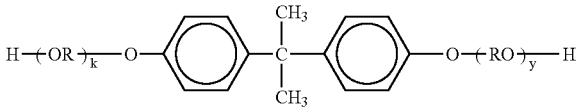

(In the formula, R represents an ethylene group or a propylene group, x and y each represent an integer of 1 or more, and an average of x+y is 2 to 10.)

The term "hybrid resin" in the binder resin to be incorporated into the toner that can be used in the present invention means a resin in which a vinyl-based polymer unit and a polyester unit are chemically bound to each other. To be specific, the hybrid resin is a resin formed by an ester exchange reaction between a polyester unit and a vinyl-based polymer unit obtained by polymerizing monomers each having a carboxylate group such as (meth) acrylate. The hybrid resin is preferably a graft copolymer (or a block copolymer) having a vinyl-based polymer as a backbone polymer and a polyester unit as a branch polymer. In the present invention, the term "polyester unit" refers to a portion derived from polyester, while the term "vinyl-based polymer unit" refers to a portion derived from a vinyl-based polymer. Examples of a polyester-based monomer constituting a polyester unit include a polyvalent carboxylic acid component and a polyhydric alcohol component. An example of a vinyl-based polymer unit includes a monomer component having a vinyl group.

Examples of the vinyl-based monomer for forming a vinyl-based copolymer or a vinyl-based polymer unit include: styrene; styrenes such as o-methylstyrene, m-methylstyrene, p-methylstyrene, α-methylstyrene, p-phenylstyrene, p-ethylstyrene, 2,4-dimethylstyrene, p-n-butylstyrene, p-tert-butylstyrene, p-n-hexylstyrene, p-n-ocytlstyrene, p-n-nonylstyrene, p-n-decylstyrene, p-n-dodecylstyrene, p-methoxystyrene, p-chlorostyrene, 3,4-dichlorostyrene, m-nitrostyrene, o-nitrostyrene, and p-nitrostyrene, and derivatives thereof; unsaturated monoolefins such as ethylene, propylene, butylene, and isobutylene; unsaturated polyenes such as butadiene and isoprene; halogenated vinyls such as vinyl chloride, vinylidene chloride, vinyl bromide, and vinyl fluoride; vinyl esters such as vinyl acetate, vinyl propionate, and vinyl benzoate; α-methylene aliphatic monocarboxylates such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylates such as methyl acrylate, ethyl acrylate, propyl acrylate, n-butyl acrylate, isobutyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinylpyrrole, N-vinylcarbazole, N-vinylindole, and N-vinylpyrolidone; vinyl naphthalenes; and acrylic acid derivatives or methacrylic acid derivatives such as acrylonitrile, methacrylonitrile, and acrylamide.

The examples further include: unsaturated dibasic acids such as maleic acid, citraconic acid, itaconic acid, alkenyl succinic acid, fumaric acid, and mesaconic acid; unsaturated dibasic acid anhydrides such as maleic anhydride, citraconic anhydride, itaconic anhydride, and alkenyl succinic anhydride; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenyl succinate half ester, methyl fumarate half ester, and methyl mesacoate half ester; unsaturated dibasic esters such as dimethyl maleate and dimethyl fumarate; α,β-unsaturated acids such as acrylic acid, methacrylic acid, crotonic acid, and cinnamic acid; α,β-unsaturated acid anhydrides such as crotonic anhydride and cinnamic anhydride; anhydrides of the α,β-unsaturated acids and lower aliphatic acids; and monomers having carboxyl groups such as alkenyl malonic acid, alkenyl glutaric acid, alkenyl adipic acid, and acid anhydrides and monoesters thereof.

The examples further include: acrylates and methacrylates such as 2-hydroxyethyl acrylate, 2-hydroxyethyl methacrylate, and 2-hydorypropyl methacrylate; and monomers having hydroxyl groups such as 4-(1-hydroxy-1-methylbutyl)styrene and 4-(1-hydroxy-1-methylhexyl)styrene.

In the toner that can be used in the present invention, the vinyl-based copolymer or the vinyl-based polymer unit of the binder resin may have a cross-linking structure formed by a cross-linking agent having two or more vinyl groups. Examples of the cross-linking agent used at this time include: aromatic divinyl compounds such as divinylbenzene and divinylnaphthalene; diacrylate compounds connected by alkyl chains such as ethylene glycol diacrylate, 1,3-butylene glycol diacrylate, 1,4-butanediol diacrylate, 1,5-pentanediol diacrylate, 1,6-hexanediol diacrylate, neopentylglycol diacrylate, and compounds obtained by changing "acrylate" of these compounds to "methacrylate"; diacrylate compounds connected by alkyl chains containing ether bonds such as diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and compounds obtained by changing "acrylate" of these compounds to "methacrylate"; and diacrylate compounds connected by chains containing aromatic groups and ether bonds such as polyoxyethylene(2)-2,2-bis(4-hydroxyphenyl)propane diacrylate, polyoxyethylene(4)-2,2-bis(4-hydroxyphenyl)propane diacrylate, and compounds obtained by changing "acrylate" of these compounds to "methacrylate".

Examples of a polyfunctional cross-linking agent include: pentaerythritol triacrylate, trimethylolethane triacrylate, trimethylolpropane triacrylate, tetramethylolpropane tetraacrylate, oligoester acrylate, and compounds obtained by changing "acrylate" of these compounds to "methacrylatell"; triallylcyanurate; and triallyltrimellitate.

In producing a hybrid resin, a monomer component capable of reacting with components of a vinyl-based polymer unit and a polyester unit is preferably incorporated into one or both of the units. Examples of a monomer capable of reacting with a component of the vinyl-based polymer unit out of the monomers constituting the polyester resin unit include unsaturated dicarboxylic acids such as phthalic acid, maleic acid, citraconic acid, and itaconic acid, and anhydrides thereof. Examples of a monomer capable of reacting with a component of the polyester unit out of the monomers constituting the vinyl-based polymer unit include: monomers each having a carboxyl group or a hydroxyl group; and acrylates and methacrylates.

A preferable method of producing a reaction product of a vinyl-based polymer unit and a polyester unit involves subjecting one or both of the vinyl-based polymer unit and the polyester unit to a polymerization reaction in the presence of a polymer containing a monomer component capable of reacting with each of the resins to produce the reaction product.

Examples of a polymerization initiator used for producing a vinyl-based copolymer or a vinyl-based polymer unit that can be used in the present invention include: ketone peroxides such as 2,2'azobisisobutyronitrile, 2,2'-azobis(4-methoxy-2,4-dimethylvaleronitrile), 2,2'-azobis(-2,4-dimethylvaleronitrile), 2,2'-azobis(-2methylbutyronitrile), dimethyl-2,2'-azobisisobutyrate, 1,1'-azobis(1-cyclohexanecarbonitrile), 2-(carbamoylazo)-isobutyronitrile, 2,2'-azobis(2,4,4-trimethylpentane), 2-phenylazo-2,4-dimethyl-4-methoxyvaleronitrile, 2,2'-azobis(2-methyl-propane), methyl ethyl ketone peroxide, acetyl acetone peroxide, and cyclohexanone peroxide; 2,2'-bis(t-butylperoxy)butane; t-butyl hydroperoxide; cumene hydroperoxide; 1,1,3,3-tetramethylbutyl hydroperoxide; di-t-butyl peroxide; t-butylcumyl peroxide; dicumyl peroxide; α,α'-bis(t-butylperoxyisopropyl)benzene; isobutyl peroxide; octanoyl peroxide; decanoyl peroxide; lauroyl peroxide; 3,5,5-trimethylhexanoyl peroxide; benzoyl peroxide; m-trioyl perxoxide; diisopropylperoxydicarbonte; di-2-ethylhexylperoxydicarbonte; di-n-propylperoxydicarbonte; di-2-ethoxyethylperoxycarbonte; di-methoxyisopropylperoxydicarbonte; di(3-methyl-3-methoxybutyl)peroxydicarbonte; aceatyl cyclohexyl sulfonyl peroxide; t-butylperoxyacetate; t-butylperoxyisobutyrate; t-butylperoxyneodecanoate; t-butylperoxy-2-ethylhexanoate; t-butylperoxylaurate; t-butylperoxybenzoate; t-butylperoxyisopropylcarbonate; di-t-butylperoxyisophthalate; t-butylperoxyallylcarbonate; t-amylperoxy-2-ethylhexanoate; di-t-butylperoxyhexahydroterephthalate; and di-t-butylperoxyazelate.

Examples of a method of preparing a hybrid resin to be used in the toner that can be used in the present invention include the methods described in the following items (1) to (5).

(1) A method involving: separately producing a vinyl-based polymer and a polyester resin; dissolving and swelling the vinyl-based resin and the polyester resin in a small amount of an organic solvent; adding an esterification catalyst and alcohol; and performing an ester exchange reaction by heating the mixture to synthesize a hybrid resin.

(2) A method in which a polyester unit and a hybrid resin component are produced in the presence of a vinyl-based polymer after the production of the vinyl-based polymer. The hybrid resin component is produced by a reaction between the vinyl-based polymer unit (a vinyl-based monomer may be added as required) and a polyester monomer (for example, a polyhydric alcohol or a polyvalent carboxylic acid), and a reaction among the unit, the monomer, and polyester to be added as required. An organic solvent can be used as appropriate in this case as well.

(3) A method in which a vinyl-based polymer unit and a hybrid resin component are produced in the presence of a polyester resin after the production of the polyester resin. The hybrid resin component is produced by a reaction between the polyester unit (a polyester monomer may be added as required) and a vinyl-based monomer, and a reaction among the unit, the monomer, and the vinyl-based polymer unit added as required. An organic solvent can be used as appropriate in this case as well.

(4) A method of producing a hybrid resin component involving: producing a vinyl-based polymer and a polyester resin; and adding one or both of a vinyl-based monomer and a polyester monomer (for example, a polyhydric alcohol or a polyvalent carboxylic acid) in the presence of these polymer units to carry out a polymerization reaction under conditions corresponding to the added monomer. An organic solvent can be used as appropriate in this case as well.

(5) A method in which a vinyl-based monomer and a polyester monomer (for example, a polyhydric alcohol or a polyvalent carboxylic acid) are mixed to successively carry out addition polymerization and a condensation polymerization reaction to thereby produce a vinyl-based polymer unit, a polyester unit, and a hybrid resin component. In addition, an organic solvent can be used as appropriate.

In each of the methods described in the above items (1) to (5), multiple polymer units different from each other in molecular weight and in degree of cross-linking can be used for each of the vinyl-based polymer unit and the polyester unit.

The vinyl-based polymer or the vinyl-based polymer unit in the present invention refers to a vinyl-based homopolymer or a vinyl-based copolymer, or a vinyl-based homopolymer unit or a vinyl-based copolymer unit.

Furthermore, a molecular weight distribution measured by gel permeation chromatography (GPC) of the resin having the polyester unit that can be used in the present invention has a main peak in the molecular weight range of preferably 3,500 to 15,000, or more preferably 4,000 to 13,000. In addition, a ratio Mw/Mn of the resin is preferably 3.0 or more, or more preferably 5.0 or more. When the main peak is in the molecular weight range of less than 3,500, hot offset resistance of the toner reduces. On the other hand, when the main peak is in the molecular weight range in excess of 15,000, low-temperature fixability of the toner is insufficient, and OHP transparency reduces. In addition, a ratio Mw/Mn of less than 3.0 may reduce hot offset resistance.

In addition, the toner that can be used in the present invention preferably contains wax as a releasing agent from the viewpoint of increase in fixability.

Examples of the wax that can be used in the present invention include: aliphatic hydrocarbon-based waxes such as low-molecular-weight polyethylene, low-molecular-weight polypropylene, alkylene copolymers, microcrystalline wax, paraffin wax, and Fisher-Tropsch wax; oxides of aliphatic hydrocarbon-based waxes such as polyethylene oxide wax, and block copolymers thereof; waxes mainly composed of aliphatic esters such as carnauba wax, behenyl behenate, and montanate wax; and products obtained by deoxidizing aliphatic esters in whole or in part such as deoxidized carnauba wax. The examples further include: saturated straight chain aliphatic acids such as palmitic acid, stearic acid, and montanic acid; unsaturated aliphatic acids such as brassidic acid, eleostearic acid, and valinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; esters of aliphatic acids such as palmitic acid, stearic acid, behenic acid, and montanic acid, and alcohols such as stearyl alcohol, aralkyl alcohol, behenyl alcohol, carnaubyl alcohol, ceryl alcohol, and melissyl alcohol; aliphatic acid amides such as linoleic acid amide, oleic acid amide, and lauric acid amide; saturated aliphatic acid amides such as methylenebisstearic acid amide, ethylenebiscapric acid amide, ethylenebislauric acid amide, and hexamethylenebisstearic acid amide; unsaturated aliphatic acid amides ethylenebisoleic acid amide, hexamethylenebisoleic acid amide, N,N'diolelyladipic acid amide, and N,N'dioleylsebacic acid amide; aromatic bisamides such as m-xylenebisstearic acid amide and N,N'distearylisophthalic acid amide; aliphatic metal salts (generally called metal soaps) such as calcium stearate, calcium laurate, zinc stearate, and magnesium stearate; waxes obtained by grafting aliphatic hydrocarbon-based waxes with vinyl-based monomers such as styrene and acrylic acid; partially esterified products of aliphatic acids and polyhydric alcohols such as behenic monoglyceride; and methyl ester compounds having hydroxyl groups obtained by, for example, hydrogenation of vegetable fats and oils.

For example, an esterified product as an ester of an aliphatic hydrocarbon-based wax, an aliphatic acid, and an alcohol is a wax that can be particularly preferably used in the present invention. Examples of a preferable esterified product include: a low-molecular-weight alkylene polymer obtained by radical polymerization of alkylene under high pressure or polymerization thereof under low pressure using a Ziegler catalyst or a metallocene catalyst; an alkylene polymer obtained by thermal decomposition of a high-molecular-weight alkylene polymer; and synthetic hydrocarbon wax obtained from a residue on distillation obtained from synthetic gas containing carbon monoxide and hydrogen by Arge method, or synthetic hydrocarbon wax obtained by hydrogenation of carbon monoxide and hydrogen. One obtained by fractionation of hydrocarbon wax according to a press sweating method, a solvent method, use of vacuum distillation, or fractional crystallization system is more preferably used. The hydrocarbon as a parent body is preferably any one of: a hydrocarbon synthesized by a reaction between carbon monoxide and hydrogen using a metal oxide-based catalyst (in many cases, the catalyst contains multiple (two or more) elements) [for example, a hydrocarbon compound synthesized by a synthol method or a hydrocol method (using a fluid catalyst bed)]; a hydrocarbon having up to several hundreds carbon atoms obtained according to Arge method (using a identification catalyst bed) with which a wax-like hydrocarbon is often obtained; or a hydrocarbon obtained by polymerization of an alkylene such as ethylene by using a Ziegler catalyst because the hydrocarbon has a small number of branches each having a small size, and is a saturated long straight chain hydrocarbon. Wax synthesized by a method not involving polymerization of an alkylene is particularly preferable because of its molecular weight distribution. Paraffin wax is also preferably used.

In addition, a peak temperature of the highest endothermic peak in the temperature range of 30 to 200° C. in an endothermic curve in differential thermal analysis (DSC) measurement of the wax that can be used in the present invention is in the range of preferably 60 to 130° C., more preferably 65 to 125° C., or particularly preferably 65 to A peak temperature of the highest endothermic peak of the wax in the range of 60 to 130° C. is preferable because appropriate fine dispersibility in the toner particles can be achieved and an effect of the present invention can be exerted. A peak temperature of the highest endothermic peak of less than 60° C. tends to deteriorate blocking resistance of the toner. On the other hand, a peak temperature of the highest endothermic peak in excess of 130° C. tends to deteriorate fixability.

Any one of the conventionally known dyes and/or pigments is used as a colorant for use in the toner that can be used in the present invention. A pigment, which may be used alone, is preferably used in combination with a dye to increase color definition in terms of image quality of a full-color image.

Examples of a coloring pigment for magenta toner include a condensed azo compound, a diketopyrropyrrole compound, anthraquinone, a quinacridone compound, a basic dye lake compound, a naphthol compound, a benzimidazolone compound and a thioindigo compound. Specific examples thereof include: C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 144, 146, 150, 163, 166, 169, 177, 184, 185, 202, 206, 207, 209, 220, 221, and 254; C.I. Pigment Violet 19; and C.I. Vat Red 1, 2, 10, 13, 15, 23, 29, and 35.

Examples of a dye for magenta toner include: oil soluble dyes such as C.I. Solvent Red 1, 3, 8, 23, 24, 25, 27, 30, 49, 81, 82, 83, 84, 100, 109, and 121, C.I. Disperse Red 9, C.I. Solvent Violet 8, 13, 14, 21, and 27, and C.I. Disperse Violet 1; and basic dyes such as C.I. Basic Red 1, 2, 9, 12, 13, 14, 15, 17, 18, 22, 23, 24, 27, 29, 32, 34, 35, 36, 37, 38, 39, and 40, and C.I. Basic Violet 1, 3, 7, 10, 14, 15, 21, 25, 26, 27, and 28.

Examples of a coloring pigment for cyan toner include: C.I. Pigment Blue 1, 2, 3, 7, 15:2, 15:3, 15:4, 16, 17, 60, 62, and 66; C.I. Vat Blue 6; C.I. Acid Blue 45; and a copper phthalocyanine pigment obtained by substituting a phthalocyanine skeleton having a structure represented by the following formula (F) by 1 to 5 phtalimidemethyl groups.

(F)

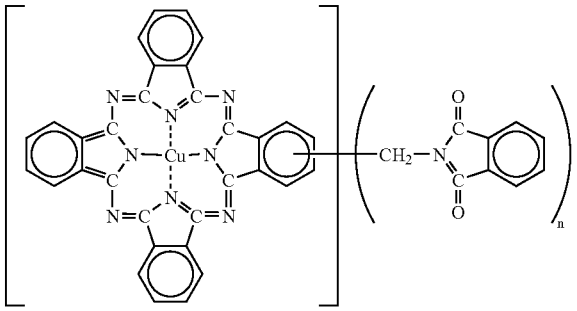

Examples of a coloring pigment for yellow toner include a condensed azo compound, an isoindolinone compound, an anthraquinone compound, an azo metal compound, a methine compound, and an allylamide compound. Specific examples thereof include: C.I. Pigment Yellow 1, 2, 3, 4, 5, 6, 7, 10, 11, 12, 13, 14, 15, 16, 17, 23, 62, 65, 73, 74, 83, 93, 95, 97, 109, 110, 111, 120, 127, 128, 129, 147, 155, 168, 174, 180, 181, 185, and 191; C.I. Vat Yellow 1, 3, and 20. Dyes such as C.I. Direct Green 6, C.I. Basic Green 4, C.I. Basic Green 6, and Solvent Yellow 162 are also available.

A black colorant that can be used in the present invention is one toned to black by using carbon black, iron oxide particles, and the yellow/magenta/cyan colorants described above.

In addition, in the toner that can be used in the present invention, one obtained by mixing a colorant in the binder resin of the present invention in advance for masterbatching is preferably used. Then, the colorant masterbatch and other raw materials (such as a binder resin and wax) are melt and kneaded, whereby the colorant can be satisfactorily dispersed into the toner.

In the case where a resin and a colorant that can be used in the present invention are used to be masterbatchd, the dispersibility of the colorant does not deteriorate even if a large amount of colorant is used. In addition, the dispersibility of the colorant in toner particles becomes good, and in fixing the toner of multiple colors to perform the image forming, color reproducibility of the colorant such as color mixability or transparency becomes excellent. Furthermore, it becomes possible to obtain toner having a large covering power on a transfer material as a result of masterbatching. Moreover, the dispersibility of the colorant becomes good as a result of the masterbatching, whereby durability of toner chargeability becomes excellent and an image maintaining high quality can be obtained.

The amount of the colorant used in the toner is preferably 0.1 to 15 parts by mass, more preferably 0.5 to 12 parts by mass, or most preferably 2 to 10 parts by mass with respect to 100 parts by mass of the binder resin in terms of color reproducibility and developability.

Any one of the conventionally known charge control agents can be used for the toner that can be used in the present invention for the purpose of stabilizing the chargeability of the toner. The amount of the charge control agent to be incorporated into the toner particles is in the range of 0.1 to 10 parts by mass, or more preferably 0.1 to 5 parts by mass with respect to 100 parts by mass of the binder resin in the toner particles, although the amount varies depending on the kind of the charge control agent, physical properties of other materials constituting toner particles, and the like. Known as such a charge control agent is each of a charge control agent for controlling toner to have negative charging property (hereinafter, referred to as a negative charge control agent) and a charge control agent for controlling toner to have positive charging property (hereinafter, referred to as a positive charge control agent). One of or two or more of various charge control agents can be used depending on the kind and applications of toner.

Examples of the negative charge control agent include: metal salicylate compounds; metal naphthoate compounds; metal dicarboxylate compounds; polymer compounds each having a sulfonic acid or a carboxylic acid at a side chain thereof; boron compounds; urea compounds; silicon compounds; and calixarene. Examples of the positive charge control agent include: quaternary ammonium salts; polymer compounds having the quaternary ammonium salts at their side chains; guanidine compounds; and imidazole compounds. The charge control agent may be internally or externally added to the toner particles.

In color toner that can be used in the present invention, an aromatic carboxylic acid metal compound is preferable which is colorless, which provides a high charging speed of toner, and which can stably maintain a constant charge amount is particularly preferable.

The toner that can be used in the present invention is preferably used after its flowability has been adjusted by mixing inorganic fine particles by using a mixer such as a Henschel mixer after pulverization and classification or after surface modification.

The inorganic fine particles that can be used in the present invention each have an aspect ratio (a major axis/a minor axis) on a toner particle surface in the range of 1.0 to 1.5 and have a number average particle size in the range of 0.06 to 0.30 μm.

When the aspect ratio of each of the inorganic fine particles is within the range, the flowability of the toner tends to increase after the addition of the inorganic fine particles and the control of the flowability of the toner on the basis of an amount of the inorganic fine particles added can be easily performed. When the aspect ratio of each of the inorganic fine particles exceeds 1.5, adhesiveness to the toner particle surface reduces, and the control of the flowability of the toner on the basis of an amount of the inorganic fine particles added is hardly performed.

In addition, when the number average particle size of the inorganic fine particles is in the range of 0.06 to 0.30 μm, a spacer effect of the inorganic fine particles between toner particles is exerted more effectively, so the flowability of the toner easily increases. When the number average particle size of the inorganic fine particles is smaller than 0.06 μm, a spacer effect is hardly obtained, and a large amount of inorganic fine particles must be added, which may result cause developability or fixability to deteriorate. When the number average particle size of the inorganic fine particles is larger than 0.30 μm, adhesiveness to the toner particle surface reduces, so a spacer effect is hardly obtained.

Examples of inorganic fine particles each having such a shape and a particle size include: a fluorine-based resin powder such as a vinylidene fluoride fine powder or a polytetrafluoroethylene fine powder; a titanium oxide fine powder; an alumina fine powder; fine powdered silica such as dry process silica or wet process silica; and treated silica obtained by subjecting such silica to surface treatment with a silane compound, an organic silicon compound, a titanium coupling agent, silicone oil, or the like.

In the present invention, the wet process silica is particularly preferable. In particular, examples of the wet process silica include silica particles obtained by a sol-gel process involving: removing a solvent from a silica sol suspension obtained by the hydrolysis and condensation reaction of alkoxysilane in an organic solvent containing water using a catalyst; and drying the remainder to produce particles. The silica particles produced by the sol-gel process have a sharp particle size distribution and substantially spherical shapes. In addition, a desired particle size distribution can be obtained by changing a reaction time. Therefore, the silica particles produced by the sol-gel process are particularly preferably used in the present invention.

The dry process silica can also be suitably used. The dry process silica is a fine powder produced by vapor-phase oxidation of a silicon halide compound, is called dry silica or fumed silica, and is produced by any one of the conventionally known techniques. An example of such techniques involves the use of a thermal decomposition oxidation reaction in an oxyhydrogen flame of silicon tetrachloride gas, and a basic reaction formula for the reaction is as follows.

$$SiCl_4+2H_2+O_2 \rightarrow SiO_2+4HCl$$

In the production process, for example, another metal halide compound such as aluminum chloride or titanium chloride is used in combination with the silicon halide compound, whereby a composite fine powder of silica and any other metal oxide can be obtained, and such a composite fine powder is also included in the present invention.

In addition, a sulfuric acid method, chlorine method, or volatile titanium compound (for example, titanium oxide fine particles obtained by low-temperature oxidation (thermal decomposition or hydrolysis) of titanium alkoxide, titanium halide, or titanium acetylacetonate) can be used as the titanium oxide fine powder. Any one of an anatase type, a rutile type, a mixture of them, and an amorphous type can be used as a crystal system.

An alumina fine powder obtained by a Byers process, an improved Byers process, an ethylene chlorohydrin method, underwater spark discharge method, an organic aluminum hydrolysis method, an aluminum alum thermal decomposition method, an ammonium aluminum carbonate thermal decomposition method, or a flame decomposition method of aluminum chloride can be used as the alumina fine powder Any one of α, β, γ, δ, ξ, η, θ, κ, χ, and ρ types, a mixture of them, and an amorphous type is available as a crystal system, and any one of α, δ, γ, and θ, a mixture of them, and an amorphous type is preferably used.

Hydrophobic property can be imparted to the inorganic fine powder by chemically or physically treating the inorganic fine powder with, for example, an organic silicon compound that reacts with or physically adsorbs to the inorganic fine powder.

A preferable method involves treating a silica fine powder produced by vapor-phase oxidation of a silicon halide compound with an organic silicon compound. Examples of the organic silicon compound include hexamethyl disilazane, trimethyl silane, trimethyl chlorosilane, trimethyl ethoxysilane, dimethyl dichlorosilane, methyl trichlorosilane, allyldimethyl chlorosilane, allylphenyl dichlorosilane, benzyldimethyl chlorosilane, bromomethyl dimethylchlorosilane, α-chloroethyl trichlorosilane, β-chloroethyl trichlorosilane, chloromethyl dimethylchlorosilane, triorganosilyl mercaptan, trimethylsilyl mercaptan, triorganosilyl acrylate, vinyldimethyl acetoxysilane, dimethylethoxy silane, dimethyldimethoxy silane, diphenyldiethoxy silane, hexamethyl disiloxane, 1,3-divinyl tetramethyl disiloxane, 1,3-diphenyl tetramethyl disiloxane, and dimethyl polysiloxane having 2 to 12 siloxane units per molecule and a hydroxyl group bonded to one silicon atom on each unit located on the terminal of the molecule. Each of them may be used alone, or two or more of them maybe used as a mixture.

The wet process silica or dry process silica described above treated with a coupling agent having an amino group or with silicone oil may be used as the inorganic fine particles that can be used in the present invention as required in order to achieve the object of the present invention. In addition, the amount of the inorganic fine particles to be added is desirably 0.01 to 8 parts by mass, or preferably 0.1 to 4 parts by mass with respect to 100 parts by mass of the toner.

Next, the procedure for producing toner will be described.

The toner that can be used in the present invention is particularly preferably produced by: melting and kneading a binder resin, a colorant, a wax, and any other arbitrary material; cooling the kneaded product; pulverizing the cooled product; subjecting the pulverized product to spheroidization treatment or classification treatment as required; and mixing the resultant with the inorganic fine particles as required.

First, in a raw material mixing step, predetermined amounts of at least a resin and a colorant as toner internal additive are weighed, blended, and mixed. Examples of a mixing device include a Doublecon mixer, a V-type mixer, a drum type mixer, a Super mixer, a Henschel mixer, and a Nauta mixer.

Furthermore, the toner raw materials blended and mixed in the above step are melted and kneaded to melt resins, followed by dispersion of a colorant or the like into the resultant. In the melting and kneading step, a batch-type kneader such as a pressure kneader or a Banbury mixer, or a continuous kneader can be used. In recent years, a mono-axial or biaxial extruder has gone mainstream because of its superiority such as its ability to perform continuous production. For example, a KTK type biaxial extruder manufactured by Kobe Steel, Ltd., a TEM type biaxial extruder manufactured by Toshiba Machine Co., Ltd., a biaxial extruder manufactured by KCK, or a COKNEADER manufactured by Bus is generally used. Furthermore, a colored resin composition obtained by melting and kneading the toner raw materials is rolled by a two-roll or the like after the melting and kneading, and is cooled through a cooling step for cooling with water or the like.

Then, in general, the cooled product of the colored resin composition obtained in the above step is pulverized into particles each having a predetermined particle size in a pulverizing step. In the pulverizing step, the cooled product is coarsely pulverized by means of a crusher, a hammer mill, a feather mill, or the like, and the coarsely pulverized product is pulverized by means of, for example, a Kryptron system manufactured by Kawasaki Heavy Industries, Ltd. or a SUPER-ROTOR manufactured by Nissin Engineering. After that, as required, the resultant is classified by means of a screen classifier such as an ELBOW-JET of an inertial classification system (manufactured by Nittetsu Mining Co., Ltd.) or a TURBOPLEX of a centrifugal force classification system (manufactured by Hosokawa Micron Corporation) to produce a classified product.

In addition, in the present invention, the classification treatment and a surface modification treatment may be simultaneously performed. A surface modification apparatus shown in FIG. 4 is preferably used.

Figure 4:
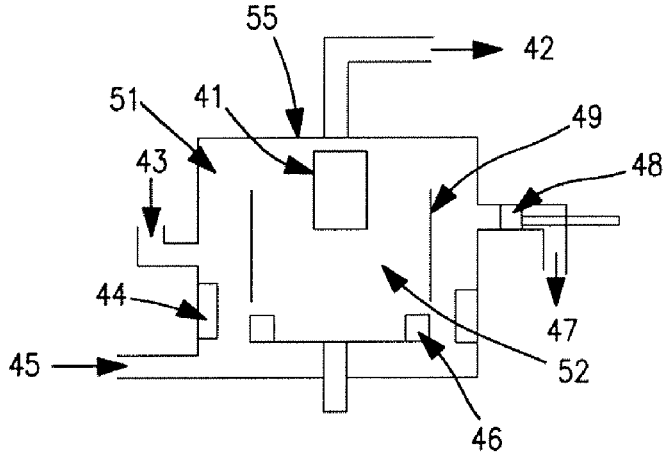
FIG. 4 is a schematic drawing showing an example of a surface modification apparatus of toner.

The surface modification apparatus shown in FIG. 4 includes a casing 55, a jacket (not shown), classification rotor 41, a dispersion rotor 46, a liner 44, a guide ring 49, a discharge port 42 for collecting a fine powder, a cold air introducing port 45, a raw material supply port 43, and a powder discharge port 47 and a discharge valve 48. Coolant or antifreeze can pass through the jacket. The classification rotor 41 serves as classifying means for classifying fine particles each having a predetermined particle size or smaller. The dispersion rotor 46 serves as surface modification means for treating the surface of each of the particles by applying a mechanical impact to the particles. The liner 44 is arranged on the outer periphery of the dispersion rotor 46 while maintaining a predetermined gap. The guide ring 49 serves as guiding means for guiding particles each having a predetermined particle size out of the particles classified by the classification rotor 41 to the dispersion rotor 46. The discharge port 42 for collecting a fine powder serves as discharging means for discharging the particles each having a predetermined particle size or smaller to the outside of the apparatus. The cold air introducing port 45 serves as particle circulating means for sending the particles with surfaces treated by the dispersion rotor 46 to the classification rotor 41. The raw material supply port 43 is intended for introducing the treated particles to the casing 55. The powder discharge port 47 is freely openable/closable by the discharge valve 48 so that the surface-treated particles are discharged from the casing 55.

The classification rotor 41 is a cylindrical rotor, and is arranged on one end portion on an upper side of the casing 55. The discharge port 42 for collecting a fine powder is arranged on one end portion of the casing 55 to discharge the particles in the classification rotor 41. The raw material supply port 43 is arranged at a central portion of the peripheral surface of the casing 55. The cold air introducing port 45 is arranged on another end of the peripheral surface of the casing 55. The powder discharge port 47 is arranged at a position opposed to the raw material supply port 43 on the peripheral surface of the casing 55. The discharge valve 48 is a valve for freely opening/closing the powder discharge port 47.

Figure 5:
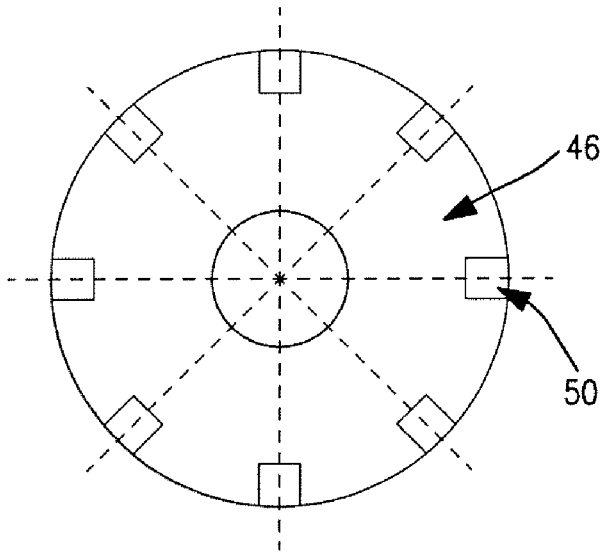
FIG. 5 is a schematic drawing showing an example of a dispersion rotor of the surface modification apparatus of FIG. 4.

The dispersion rotor 46 and the liner 44 are arranged between the cold air introducing port 45 and each of the raw material supply port 43 and the powder discharge port 47. The liner 44 is arranged along the inner peripheral surface of the casing 55. As shown in FIG. 5, the dispersion rotor 46 includes a disk and multiple square disks 50 arranged on the circumference of the disk along the normal of the disk. The dispersion rotor 46 is arranged on an upper surface on a lower side of the casing 55 so that a predetermined gap is formed between the liner 44 and each of the square disks 50. The guide ring 49 is arranged at a central portion of the casing 55. The guide ring 49 is a cylinder, and is arranged to extend from a position covering part of the outer peripheral surface of the classification rotor 41 to the vicinity of the dispersion rotor 46. The guide ring 49 forms, in the casing 55, a first space 51 sandwiched between the outer peripheral surface of the guide ring 49 and the inner peripheral surface of the casing 55 and a second space 52 as a space inside the guide ring 49.

The dispersion rotor 46 may have columnar pins instead of the square disks 50. Although the liner 44 is provided with a large number of grooves on the surface opposite to the square disks 50 in this embodiment, the liner 44 may have no grooves on the surface. In addition, an installation direction of the classification rotor 41 may be vertical as shown in FIG. 4, or may be horizontal. In addition, the number of the classification rotor 41 may be one as shown in FIG. 4, or may be two or more.

In addition, as required, additional surface modification treatment and additional spheroidization treatment may be performed by using a Hybridization System manufactured by Nara Machinery Co., Ltd., or a Mechanofusion System manufactured by Hosokawa Micron Corporation. In such a case, a screen classifier such as a HIBOLTER as a wind power sieve (manufactured by Shintokyo Kikai) may be used. Furthermore, an example of a method of externally treating an external additive includes a method involving: mixing predetermined amounts of classified toner and any one of various conventionally known additives; and stirring and mixing the materials by using as an external addition machine a high-speed stirrer that applies a shearing force to a powder such as a Henschel mixer or a Super mixer.

Examples of the other methods of producing the toner that can be used in the present invention include: a method involving using a suspension polymerization method to directly produce toner particles; a dispersion polymerization method involving using an aqueous organic solvent in which a monomer is soluble and a polymer to be obtained is insoluble to directly produce toner particles; and a method of directly producing toner particles by using an emulsion polymerization method typified by a soap free polymerization method involving directly polymerizing monomers in the presence of a water-soluble polar polymerization initiator. An interfacial polymerization method such as a microcapsule production method, or a production method such as an in situ polymerization method or a coacervation method may also be used.

In the case where the suspension polymerization method is used to produce toner particles, an azo-based polymerization initiator such as 2,2'-azobis-(2,4-dimethylvaleronitrile), 2,2'-azobisisobutyronitrile, 1,1'-azobis(cyclohexane-1-carbonitrile), 2,2'-azobis-4-methoxy-2,4'-dimethylvaleronitrile, or azobisisobutyronitrile, or a peroxide-based polymerization initiator such as benzoyl peroxide, methyl ethyl ketone peroxide, diisopropylperoxycarbonate, cumene hydroperoxide, 2,4-dichlorobenzoyl peroxide, or lauroyl peroxide is used as a polymerization initiator.

The addition amount of the polymerization initiator, which varies depending on a target degree of polymerization, is generally 0.5 to 20 mass % with respect to the monomer. The number of kinds of polymerization initiators to be used, which slightly varies depending on a polymerization method, is one or two or more with reference to a temperature at which half of the polymerization initiator is decomposed in 10 hours. A conventionally known cross-linking agent, chain transfer,agent, polymerization inhibitor, or the like may be further added for controlling a degree of polymerization.

In the case where suspension polymerization is used as a method of producing toner, an inorganic oxide may be used as a dispersant. Examples of the inorganic oxide include tricalcium phosphate, magnesium phosphate, aluminum phosphate, zinc phosphate, calcium carbonate, magnesium carbonate, calcium hydroxide, magnesium hydroxide, aluminum hydroxide, calcium metasilicate, calcium sulfate, barium sulfate, bentonite, silica, and alumina. Examples of an organic compound include: sodium salts of polyvinyl alcohol, gelatin, methylcellulose, methylhydroxypropylcellulose, ethylcellulose, and carboxymethylcellulose; and starches. Each of those is dispersed into an aqueous phase before use. Each of those dispersants is preferably used in an amount of 0.2 to 10.0 parts by mass with respect to 100 parts by mass of a polymerizable monomer.

Although each of those dispersants may be a commercially available one without treatment, the inorganic oxide can be produced in a dispersion medium under high-speed stirring in order to obtain dispersed particles each having a fine and uniform grain size. For example, in the case of tricalcium phosphate, an aqueous solution of sodium phosphate and an aqueous solution of calcium chloride are mixed under high-speed stirring, whereby a dispersant suitable for a suspension polymerization method can be obtained. 0.001 to 0.1 part by mass of a surfactant may also be used in combination in order to refine the dispersant. To be specific, a commercially available nonionic, anionic, or cationic surfactant can be used. Examples of a surfactant preferably used include sodium dodecylsulfate, sodium tetradecylsulfate, sodium pentadecylsulfate, sodium octylsulfate, sodium oleate, sodium laurate, potassium stearate, and calcium oleate.

In the case where a direct polymerization method is used as a method of producing toner, toner can be specifically produced by the following production method. A monomer composition, which is obtained by: adding a releasing agent, a colorant, a charge control agent, a polymerization initiator, or any other additive, each of which is composed of a low-softening-point substance, to a monomer; and uniformly dissolving or dispersing the low-softening-point substance into the monomer by means of a homogenizer, an ultrasonic dispersing device, or the like, is dispersed into an aqueous phase containing a dispersion stabilizer by means of an ordinary stirring machine, a homomixer, a homogenizer, or the like. Preferably, a liquid droplet composed of the monomer composition is granulated while a stirring speed and a stirring time are adjusted so that a predetermined toner particle size is obtained. After that, it is sufficient to perform stirring to such an extent that a particle state is maintained and sedimentation of particles is prevented by virtue of an action of the dispersion stabilizer. Polymerization is performed at a polymerization temperature of 40° C. or higher, generally 50 to 90° C. The temperature may be increased at a latter half of the polymerization reaction. Furthermore, for the purpose of improving durability, part of the aqueous medium may be distilled off at the latter half of the reaction or after the completion of the reaction to remove an unreacted polymerizable monomer and a by-product. After the completion of the reaction, the produced toner particles are collected by washing and filtration, followed by drying. In the suspension polymerization method, in general, 300 to 3,000 parts by mass of water are preferably used as a dispersion medium with respect to 100 parts by mass of the monomer composition.

Next, wettability of the toner that can be used in the present invention with respect to a 45% aqueous solution of methanol will be described in detail.

With regard to the wettability of the toner that can be used in the present invention, the toner preferably has a transmittance in the range of 10 to 80% in UV transmittance measurement in a 45-vol % aqueous solution of methanol. When the transmittance is within the range, the degree of compression and shearing stress of the developer of the present invention can be easily obtained.

When the transmittance is smaller than 10%, flowability of the toner deteriorates, so the shearing stress of the developer tends to be large, and the stress to the developer may be large.

When the transmittance is larger than 80%, flowability of the toner is excessively good, so the degree of compression of the developer tends to be small, and uneven coating or scattering of the developer is apt to occur on a developing sleeve.

Therefore, the wettability of the toner is preferably within the above range. In the present invention, the range can be achieved by changing the particle size and aspect ratio of an external additive.

Next, the shape of the toner that can be used in the present invention will be described in detail.

With regard to the shape of the toner that can be used in the present invention, the toner preferably has an average circularity in the range of 0.920 to 0.970 measured by means of an FPIA 2100 (manufactured by Sysmex Corporation).

When the average circularity is smaller than 0.920, flowability of the toner deteriorates, so the shearing stress of the developer tends to be large, and the stress to the developer may be large.

When the average circularity is larger than 0.970, flowability of the toner is excessively good, so the degree of compression of the developer tends to be small, and uneven coating or scattering of the developer is apt to occur on a developing sleeve.

Therefore, the shape of the toner preferably satisfies the above range. In the present invention, the range can be achieved by adjusting pulverization conditions and surface modification treatment conditions for the toner.

In addition, with regard to the average particle diameter of the toner, the toner preferably has a weight average particle diameter (D4) in the range of 4.0 to 10 μm.

When the average particle diameter is less than 4.0 μm, scattering of the developer tends to occur.

When the average particle diameter is more than 10 μm, dot repeatability at the time of development deteriorates, so the high quality image may hardly be obtained.

Therefore, the average particle diameter of the toner preferably satisfies the above range. In the present invention, the range can be achieved by adjusting pulverization conditions and surface modification treatment conditions for the toner.

Hereinafter, methods of analyzing and measuring the physical properties according to the present invention will be described.

<Measurement of Degree of Compression of Developer>

First, a aerated bulk density A (g/cm$^3$) was measured by using a POWDER TESTER PT-R (manufactured by Hosokawa Micron Corporation). The measurement environment was at 23° C. and 50% RH. In the measurement, a developer was vibrated at an amplitude of 1 mm by using a sieve having an aperture of 75 μm, and was collected in a metal cup having a volume of 100 ml to completely fill the cup (100 ml) Then, the aerated bulk density A (g/cm$^3$) was calculated from the amount of the developer collected in the metal cup.

Next, a packed bulk density P (g/cm$^3$) was measured. The metal cup was tapped vertically 180 times (a pair of an upward movement and a downward movement is regarded as one tap) while the metal cup was replenished with the developer, which was vibrated at an amplitude of 1 mm by using a sieve having an aperture of 75 μm, till full filling of the cup. Then, the packed bulk density P (g/cm$^3$) was calculated from the amount of the developer after the tapping.

Subsequently, the degree of compression C was determined from the following equation (1).

$$\text{Degree of compression } C(\%)=100\times(P-A)/P \quad (1)$$

<Measurement of Shearing Stress of Developer>

The shearing stress of the developer was measured by using a POWDER BED TESTER PTHN-13BA (manufactured by Sankyo Pio-Tech CO., Ltd.). The measurement environment was at 23° C. and 50% RH. A parallel plate-type shearing strength measurement cell was used for the measurement. First, a powder layer of the developer was formed on a fixed plate, a movable plate (measuring W 50 mm×D 70 mm×H 4 mm) was horizontally placed on the powder, and a preparatory consolidation load was applied from above the movable plate. The preparatory consolidation load was $1.3\times10^{-2}$ N/mm$^2$, and the preparatory consolidation was performed for 5 min. After that, shearing stress measurement was performed in a state where a vertical load was applied from above the movable plate in such a manner that the consolidation load to the powder layer would be $4.0\times10^{-4}$ N/mm$^2$. The measurement was repeated 6 times, and the average of the 6 measurements was defined as the shearing stress of the developer.

<Molecular Weight Distributions of Binder Resin, Toner, and Coating Resin by GPC Measurement>

The molecular weight of a chromatogram by means of gel permeation chromatography (GPC) is measured under the following conditions. An HLC-8120 GPC (manufactured by Tosoh Corporation) was used for the measurement.

A column is stabilized in a heat chamber at 40° C. Tetrahydrofuran (THF) as a solvent is allowed to flow into the column at the temperature at a flow rate of 1 ml/min. About 50 to 200 μl of a THF sample solution of a resin with a sample concentration adjusted to be within the range of 0.05 to 0.6 mass % are injected for measurement. In measuring the molecular weight of the sample, the molecular weight distribution of the sample is calculated from the relationship between a logarithmic value of a calibration curve prepared by several kinds of monodisperse polystyrene standard samples and the number of counts (retention time). Examples of available standard polystyrene samples for preparing a calibration curve include samples manufactured by Tosoh Corporation or by Pressure Chemical Co. and having molecular weights of $6\times10^2$, $2.1\times10^3$, $4\times10^3$, $1.75\times10^4$, $5.1\times10^4$, $1.1\times10^5$, $3.9\times10^5$, $8.6\times10^5$, $2\times10^6$, and $4.48\times10^6$. At least 10 polystyrene standard samples are suitably used. An RI (refractive index) detector is used as a detector.

It is recommended that multiple commercially available polystyrene gel columns be combined to be used as the column in order to precisely measure the molecular weight range of $10^3$ to $2\times10^6$. Examples of the combination include; a combination of SHODEX GPC KF-801, 802, 803, 804, 805, 806, and 807 manufactured by Showa Denko K. K.; and a combination of μ-styragel 500, $10^3$, $10^4$, and $10^5$ manufactured by Waters Corporation.

<Measurement of Highest Endothermic Peaks of Toner and Wax in DSC>

The highest endothermic peaks of toner and wax can be measured in compliance with ASTM D 3418-82 by using a differential thermal analyzer (DSC measuring device) DSC 2920 (manufactured by TA Instruments Japan).

Temperature curve: Temperature rise I (30° C. to 200° C., rate of temperature rise of 10° C./min)

Temperature decrease I (200° C. to 30° C., rate of temperature decrease of 10° C./min)

Temperature rise II (30° C. to 200° C., rate of temperature rise of 10° C./min)

A measurement method is as follows. 5 to 20 mg, preferably 10 mg of a measurement sample are precisely weighed. The sample is charged into an aluminum pan, and measurement is performed in the measurement temperature range of 30 to 200° C., at a rate of temperature rise of 10° C./min, and under normal temperature and normal humidity by using an empty pan as a reference. An endothermic peak with the highest height measured from a base line in the range above the glass transition point Tg of the resin in the process of the temperature rise II is defined as the highest endothermic peak of the toner. In the case where the endothermic peak in the range above the glass transition point Tg of the resin overlaps the other endothermic peaks, and is hardly distinguished from the other peaks, a peak with the highest height out of the local maximum peaks of the overlapping peaks is defined as the highest endothermic peak of the toner of the present invention.

<Measurement of Toner Particle Size Distribution>

A COULTER COUNTER TA-II or a COULTER MULTISIZER II (manufactured by Beckman Coulter, Inc) is used as a measuring device. An about 1% aqueous solution of NaCl is used as an electrolyte. For example, an electrolyte prepared by using extra-pure sodium chloride or ISOTON (registered trademark)-II (manufactured by Coulter Scientific Japan) can be used as the electrolyte.

A measurement method is as follows 100 to 150 ml of the electrolyte are added with 0.1 to 5 ml of a surfactant (preferably an alkylbenzene sulfonate) as a dispersant. Then, 2 to 20 mg of measurement samples are added to the electrolyte. The electrolyte into which the samples are suspended is subjected to dispersion treatment in an ultrasonic dispersing device for about 1 to 3 min. After that, by using a 100 μm aperture as an aperture, the volumes and number of samples are measured for each channel by the measuring device to calculate the volume and number distributions of the samples. The weight average particle diameter (D4) of the samples is determined form the resultant distributions. Used as the channels are 13 channels of: 2.00 to 2.52 μm; 2.52 to 3.17 μm; 3.17 to 4.00 μm; 4.00 to 5.04 μm; 5.04 to 6.35 μm; 6.35 to 8.00 μm; 8.00 to 10.08 μm; 10.08 to 12.70 μm; 12.70 to 16.00 μm; 16.00 to 20.20 μm; 20.20 to 25.40 μm; 25.40 to 32.00 μm; and 32.00 to 40.30 μm.

<Measurement of Average Circularity of Toner>

The average circularity of the toner is measured by using a flow type particle image measuring device "FPIA-2100" (manufactured by Sysmex Corporation) and calculated by using the following equation.

$$\text{Circle equivalent diameter}=(\text{Particle projected area}\times\Pi)^{1/2}\times 2$$

Circularity=(Circumferential length of a circle having the same area as that of the particle projected area)/(Circumferential length of a particle projected image)

Here, the term "particle projected area" is defined as an area of a binarized particle image, and the term "circumferential length of a particle projected image" is defined as the length of a border line obtained by connecting edge points of the particle image. In the measurement, the circumferential length of a particle image subjected to image processing at an image processing resolution of 512×512 (a pixel measuring 0.3 μm×0.3 μm) is used.

The circularity in the present invention is an indication of the degree of irregularities on a particle. When the particle is of a complete spherical shape, the circularity is 1.000. The more complex the surface shape, the smaller the circularity.

In addition, an average circularity C which means an average value of a circularity frequency distribution is calculated from the following equation where ci denotes a circularity (center value) at a division point i in the particle size distribution and m denotes the number of particles to be measured.

$$\text{Average Circularity } C=\sum_{i=1}^{m} Ci/m$$

The "FPIA-2100", which is a measuring device used in the present invention, calculates the average circularity by: calculating the circularities of the respective particles; classifying the particles into classes obtained by equally dividing the circularity range of 0.40 to 1.00 at an interval of 0.01; and using the center values of the division points and the number of particles to be measured to calculate the average circularity.

A specific measurement method is as follow. 10 ml of ion-exchanged water from which an impurity solid or the like has been removed in advance are charged into a vessel, and a surfactant as a dispersant, preferably an alkylbenzene sulfonate, is added to the ion-exchanged water. After that, 0.02 g of a measurement sample (toner) is further added to be uniformly dispersed into the mixture. The resultant mixture is subjected to dispersion treatment for 2 min by using an ultrasonic dispersing device "Tetora 150" (manufactured by Nikkaki-Bios) as dispersing means to prepare a dispersion for measurement. At that time, the dispersion is cooled as appropriate to prevent the temperature of the dispersion from becoming 40° C. or higher. In addition, in order to suppress the variations in circularities, an installation environment of the flow type particle image measuring device FPIA-2100 is controlled to 23° C.±0.5° C. in such a manner that the temperature inside the device is in the range of 26 to 27° C., and automatic focusing is performed by using 2-μm latex particles at an interval of a certain period of time, preferably 2 hours.

The flow type particle image measuring device is used for measuring the circularity of the toner. The concentration of the dispersion is readjusted in such a manner that a concentration of toner particles at the time of the measurement may be in the range of 3,000 to 10,000 particles/μl. Then, 1,000 or more toner particles are measured. After the measurement, the average circularity of the toner particles is determined by using the obtained data while cutting off data for particles each having a particle size of less than 2 μm.

As compared to an "FPIA-1000" which has been conventionally used for calculating the shape of toner, the "FPIA-2100", which is a measuring device used in the present invention, has improved accuracy of toner shape measurement owing to an increase in magnification of a processed particle image and an increase in processing resolution of a captured image (256×256→512×512) As a result, the measuring device has achieved capturing of fine particles with improved reliability. Therefore, in the case where a shape must be measured more accurately as in the present invention, the FPIA-2100 is more useful than the FPIA-1000 because the FPIA-2100 provides more accurate information about the shape.

<Measurement of UV Transmittance of Toner in 45-vol % Aqueous Solution of Methanol>

Preparation of Toner Dispersion

An aqueous solution with a methanol-to-water volume mixing ratio of 45:55 is prepared. 10 ml of the aqueous solution are charged into a 30-ml sample bottle (Nichiden-Rika Glass Co., Ltd: SV-30), and 20 mg of toner are immersed into the liquid surface, followed by capping the bottle. After that, the bottle is shaken with a Yayoi shaker (model: YS-LD) at 2.5 $s^{-1}$ for 10 sec. At this time, the angle at which the bottle is shaken is set as follows. A direction right above the shaker (vertical direction) is set to 0°, and a shaking support moves forward by 15° and backward by 20°. The sample bottle is fixed to a fixing holder (prepared by fixing the cap of the sample bottle onto an extension line of the center of the support) attached to the tip of the support. 30 seconds after the sample bottle has been taken, a dispersion is provided as a dispersion for measurement.

Permeability Measurement

The dispersion is charged into a 1-cm square quartz cell. A permeability (%) at a wavelength of 600 nm in the dispersion is determined by using a spectrophotometer MPS 2000 (manufactured by Shimadzu Corporation) 10 minutes after the cell has been loaded into the spectrophotometer.

Permeability (%)=$I/I_0\times 100$ ($I_0$: incident light intensity, I: transmitted light intensity)

<Analysis of Composition of Resin for Coating Carrier>

About 50 mg of a sample are placed into a sample tube having a diameter of 5 mm, $CDCl_3$ as a solvent is added to dissolve the sample, and the resultant is provided as a measurement sample. The measurement conditions are as follows.

Measuring device: FT NMR device JNM-EX 400 (manufactured by JEOL)

Measurement frequency: 400 MHz

Pulse condition: 6.9 μs

Data point: 32,768

Frequency range: 10,500 Hz

Number of integrations: 16

Measurement temperature: 25° C.

In addition, a resin for coating a carrier may be separated from carrier particles as required. A method of separating a coating material from carrier particles is as follows. By using a solvent in which the coating material is soluble (such as acetone or toluene), ultrasonic peeling is performed by means of an ultrasonic dispersing device After that, by using a magnet, the coating material is separated from the core particles. After that, by using a centrifugal separator, fine particles added with the coating material are separated, and the supernatant (resin solution component) is separated and evaporated to dryness. Thus, a component of a resin for coating a carrier can be obtained.

<Measurement of Specific Resistance of Magnetic Carrier>

Figure 6:
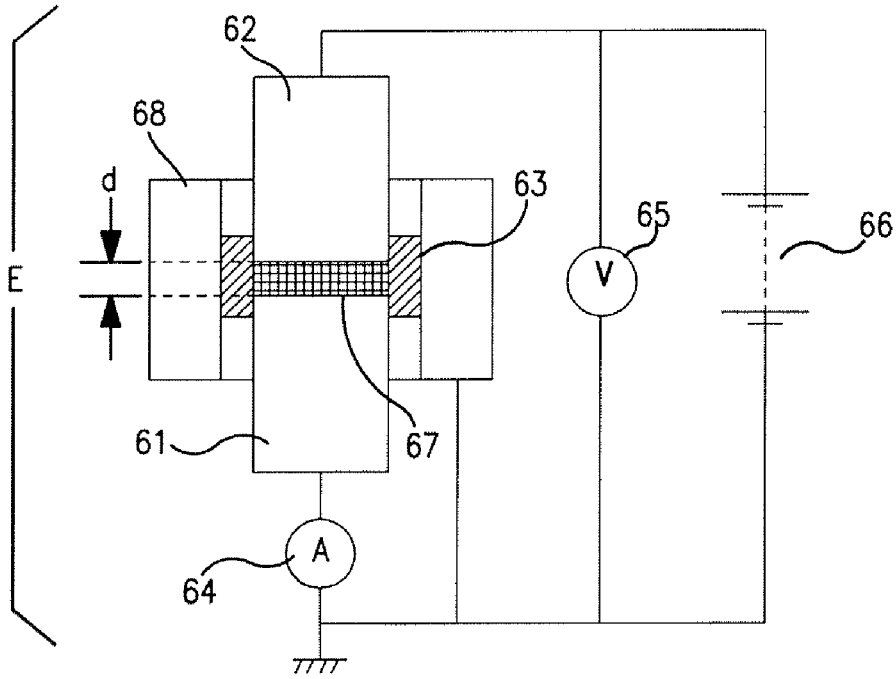
FIG. 6 is a schematic drawing of an apparatus used for measuring a specific resistance of a magnetic carrier used in the present invention.

The specific resistance of a magnetic carrier is measured by using a measuring device shown in FIG. 6. A sample is prepared by separating toner from the magnetic carrier as required.

A method to be used for measuring the specific resistance involves: filling a resistant measurement cell E with sample particles 67; arranging a lower electrode 61 and an upper electrode 62 to be in contact with the filled sample particles 67; applying a voltage between these electrodes 61 and 62 by means of a constant voltage supply 66; and measuring the current flowing at that time by means of an ammeter 64 to determine the specific resistance. The measurement conditions for the specific resistance in the present invention include: a contact area between each of the filled sample particles 67 and each of the electrodes 61 and 62 of about 2.4 $cm^2$; a thickness d of the sample of about 0.2 cm; and a load to be applied to the upper electrode 62 of 240 g. The voltage is applied in accordance with the following application conditions I, II, and III in this order, and the current at the voltage applied under the application condition III is measured. After that, the thickness d of the sample is accurately measured, a specific resistance (Ω·cm) in each electric field intensity (V/cm) is calculated, and the specific resistance in an electric field of 3,000 V/cm is defined as the specific resistance of the sample. Reference numeral 63 denotes an insulator; 65, a voltmeter; 68, a guide ring; and E, a resistance measurement cell.

Application condition I: (0 V→1,000 V: increased in a stepwise manner by 200 V every 30 sec)

II: (heldat 1,000 V for 30 sec)

III: (1,000 V→0 V: decreased in a stepwise manner by 200 V every 30 sec)

Specific resistance of sample (Ω·cm)=(Applied voltage (V)/Measured current (A))×S ($cm^2$)/d (cm)

Electric field intensity (V/cm)=Applied voltage (V)/d (cm)

<Measurement of Particle Sizes of Magnetic Fine Particle, Nonmagnetic Inorganic Compound and the Like in Carrier Core>

The particle sizes of magnetic fine particle are measured as follows. A carrier was cut by using a microtome or the like to obtain a section thereof. The resultant section is observed with a scanning electron microscope (at a magnification of 50,000) to sample 500 or more particles each having a particle size of 5 nm or more at random. The major-axis length and minor-axis length of each sampled particle are measured with a digitizer, and the average of the lengths is defined as a particle size. A particle size shown by center value in column as a peak of the particle size distribution of the 500 or more particles (by using a histogram of a column in which a column width is sectioned every 10 nm such as 5-15, 15-25, 25-35, 35-45, 45-55, 55-65, 65-75, 75-85, 85-95 (unit: nm)) is defined as the maximum peak particle size. Additionally with respect to the measurement method for the particle sizes of magnetic material or nonmagnetic in organic compound, the maximum peak particle sizes are measured in the same manner as aforementioned except that a transmission electron microscope (at a magnification of 50,000) is used instead of a scanning electron microscope.

<Measurement of Particle Sizes of Fine Particles in Resin for Coating Carrier>

The particle sizes of fine particles are measured as follows. A carrier having a coating material is placed in a solvent such as toluene in which the coating material is soluble to dissolve the coating material. The resultant component is observed with a scanning electron microscope (at a magnification of 50,000 ) to sample 500or more particles each having a particle size of 5 nm or more at random. The major-axis length and minor-axis length of each particle are measured with a digitizer, and the average of the lengths is defined as a particle size. A mode diameter as a peak of the particle size distribution of the 500 or more particles (derived from a histogram of a column sectioned every 10 nm) is defined as the average particle size <Measurement of Particle Size of Carbon Black in Resin for Coating Carrier>

The particle size of carbon black is measured as follows. A carrier having a coating material is placed in a solvent such as toluene in which the coating material is soluble to dissolve the coating material. The resultant component is observed with a scanning electron microscope (at a magnification of 50,000) to sample 500 or more particles each having a particle size of 5 nm or more at random. The major-axis length and minor-axis length of each particle are measured with a digitizer, and the average of the lengths is defined as a particle size. A mode diameter as a peak of the particle size distribution of the 500 or more particles (derived from a histogram of a column sectioned every 10 nm) is defined as the average particle size.

<Measurement of DBP Oil Absorption of Carbon Black in Resin for Coating Carrier>

The DBP oil absorption of carbon black is calculated in accordance with a DBP oil absorption (dibutyl phthalate oil absorption) according to JIS-K6221-1982 6.1.2A (machine mixing).

<Measurement of Intensity of Magnetization of Magnetic Carrier and Magnetic Fine Particle>

The intensity of magnetization of a magnetic carrier and magnetic fine particle are determined from the magnetic properties and true density of the magnetic carrier. The magnetic properties of the magnetic carrier and the magnetic fine particle can be measured by using a vibrating magnetic field-type magnetic property automatic recording device BHV-30 manufactured by Riken Denshi. Co., Ltd. A measurement method involves: filling a cylindrical plastic vessel with a magnetic carrier or a magnetic fine particle sufficiently densely; generating an external magnetic field of ($10^3/4\pi$) kA/m (1 kOe); measuring the magnetizing moment of the magnetic carrier or the magnetic fine particle filled into the vessel in this state; and measuring the actual mass of the magnetic carrier or the magnetic fine particle filled into the vessel to determine the intensity of magnetization ($Am^2/kg$) of the magnetic carrier.

<Measurement of True Density of Magnetic Carrier and Magnetic Fine Particle>

The true density of magnetic carrier particles and magnetic fine particles can be measured by using, for example, a dry type automatic densimeter 1330 (manufactured by Shimadzu Corporation). In addition, the apparent density of the carrier particles and the magnetic fine particles can be measured in accordance with JIS Z2504.

EXAMPLES

Hereinafter, the present invention will be described in more detail by way of specific production examples and examples. However, the present invention is not limited to these examples.

Production Example of Hybrid Resin

Placed into a dropping funnel were 10 parts by mass of styrene, 5 parts by mass of 2-ethylhexyl acrylate, 2 parts by mass of fumaric acid, 5 parts by mass of a dimer of α-methyl styrene, and dicumyl peroxide as materials for a vinyl-based copolymer unit. Placed into a 4-L four-necked flask made of glass were 25 parts by mass of polyoxypropylene(2.2)-2,2-bis(4-hydroxyphenyl)propane, 15 parts by mass of polyoxyethylene(2.2)-2,2-bis(4-hydroxyphenyl)propane, 9 parts by mass of terephthalic acid, 5 parts by mass of trimellitic anhydride, 24 parts by mass of fumaric acid, and dibutyltin oxide as materials for a polyester resin unit. Then, a thermometer, a stirrer, a condenser, and a nitrogen-introducing pipe were attached to the four-necked flask, and the four-necked flask was set in a mantle heater. After the air in the four-necked flask had been substituted by nitrogen gas, the temperature in the flask was gradually increased while the mixture was stirred. Then, a monomer of the vinyl-based copolymer and a polymerization initiator were dropped from the dropping funnel over about 4 hours while the mixture was stirred at 130° C. Next, the temperature in the flask was increased to 200° C., and the mixture was allowed to react for about 4 hours to yield a hybrid resin.

Molecular weight measurement of THF soluble matter of the resultant hybrid resin by means of GPC showed that the resin had a Mw of $8.9\times10^4$ and a Mn of $3.8\times10^3$. In addition, the resin was found to have a glass transition point of 62° C.

Production Example of Polyester Resin

Placed into a 4-L four-necked flask made of glass were 30 parts by mass of polyoxypropylene(2.2)-2,2-bis(4-hydroxyphenyl)propane, 10 parts by mass of polyoxyethylene(2.2)-2,2-bis(4-hydroxyphenyl)propane, 20 parts by mass of terephthalic acid, 3 parts by mass of trimellitic anhydride, 27 parts by mass of fumaric acid, and dibutyltin oxide. Then, a thermometer, a stirrer, a condenser, and a nitrogen-introducing pipe were attached to the four-necked flask, and the four-necked flask was set in a mantle heater. Under a nitrogen atmosphere, the mixture was allowed to react at 210° C. for about 5.5 hours to yield a polyester resin. Molecular weight measurement of THF soluble matter of the resultant polyester resin by means of GPC showed that the resin had a Mw of $8.7\times10^4$ and a Mn of $3.7\times10^3$. In addition, the resin was found to have a glass transition point of 59° C.

Toner Production Example 1

The following materials and method were used to produce toner (B-1).

| | |
|---|---|
| Hybrid resin described above | 100 parts by mass |
| C.I. Pigment Blue 15:3 | 4.5 parts by mass |
| Paraffin wax (W-1; highest endothermic peak 69° C., Mw 600, Mn 400) | 5 parts by mass |

The above materials were mixed by using a HENSCHEL MIXER (FM-75, manufactured by Mitsui Miike Machinery Co., Ltd.). After that, the mixture was melt and kneaded in a biaxial extruder set at a temperature of 150° C. The resultant kneaded product was cooled and then coarsely pulverized into pieces each having a size of about 1 mm or less with a hammer mill. Thus, a toner coarsely pulverized product was obtained. The resultant toner coarsely pulverized product was finely pulverized by using a collision type air pulverizer used a high pressure gas.

Next, the finely pulverized product was treated by using the surface modification apparatus shown in each of FIGS. 4 and 5. To be specific, surface treatment was performed for 45 sec at a number of revolutions of the dispersion rotor of 100 $s^{-1}$ (at a rotation peripheral speed of 130 m/sec) while fine particles were removed at a number of revolutions of the classification rotor of 120 $s^{-1}$ to obtain toner particles (after the finely pulverized product had been fed from the raw material supply port 43, treatment was performed for 45 sec, and the discharge valve 48 was opened and the resultant was taken out as a treated product). At that time, 10 square hammers were placed on an upper portion of the dispersion rotor 46, a gap between the guide ring 49 and each of the square hammers on the dispersion rotor 46 was set to 30 mm, and a gap between the dispersion rotor 46 and the liner 44 was set to 3.5 mm. In addition, the blower air quantity was set to 20 $m^3$/min, the temperature of the coolant to pass through the jacket and the temperature T1 of the cold air were each set to −20° C. This surface modification treatment was referred to as treatment A.

Then, 1.0 part by mass of titanium oxide (T-1) surface-treated with isobutyl trimethoxysilane and having a primary average particle size of 55 nm and 1.0 part by mass of hydrophobic silica (Z-1) having a number average particle size and an aspect ratio shown in Table 1 were added to 100 parts by mass of the resultant toner particles, and the whole was mixed by using a HENSCHEL MIXER (FM-75, manufactured by Mitsui Miike Machinery Co., Ltd.) at a number of revolutions of 30 $s^{-1}$ for 10 min to produce toner (B-1) The resultant toner (B-1) had a weight average particle size of 6.5 μm, an average circularity of 0.942 and a UV transmittance of 45% when stirred and mixed in a 45% methanol solution.

Toner Production Example 2

Toner (B-2) was produced in the same manner as in Toner Production Example 1 except that: the number of revolutions of the dispersion rotor at the time of surface modification treatment was changed from 100 $s^{-1}$ to 50 $s^{-1}$; the silica (Z-1) to be mixed with the resultant toner particles was changed to silica (Z-2) shown in Table 1; and the mixing time was changed to 8 min. The resultant toner (B-2) had a weight average particle size of 6.7 μm, an average circularity of 0.932 and a UV transmittance of 32% when stirred and mixed in a 45% methanol solution.

Toner Production Example 3

Toner (B-3) was produced in the same manner as in Toner Production Example 1 except that: the resultant toner particles were subjected to spheroidization treatment by using a Hybridization system (manufactured by Nara Machinery Co., Ltd.); and the silica (Z-1) to be mixed with the toner particles was changed to silica (Z-3) shown in Table 1. The resultant toner (B-3) had a weight average particle size of 6.3 μm, an average circularity of 0.955 and a UV transmittance of 62% when stirred and mixed in a 45% methanol solution.

Toner Production Example 4

Toner (B-4) was produced in the same manner as in Toner Production Example 1 except that: the silica (Z-1) to be mixed with the toner particles was changed to silica (Z-4) shown in Table 1; and the mixing time was changed to 20 min. The resultant toner (B-4) had a weight average particle size of 6.6 μm, an average circularity of 0.956 and a UV transmittance of 71% when stirred and mixed in a 45% methanol solution.

Toner Production Example 5

Toner (B-5) was produced in the same manner as in Toner Production Example 1 except that: the hybrid resin was changed to the polyester resin described above; the blower air quantity at the time of surface modification treatment was adjusted; and the silica (Z-1) to be mixed with the toner particles was changed to silica (Z-5) shown in Table 1. The resultant toner (B-5) had a weight average particle size of 4.5 μm, an average circularity of 0.940 and a UV transmittance of 79% when stirred and mixed in a 45% methanol solution.

Toner Production Example 6

450 parts by mass of a 0.1-mol/l aqueous solution of $Na_3PO_4$ were charged into 710 parts by mass of ion-exchanged water, and the mixture was heated to 60° C. After that, the resultant was stirred in a TK Homomixer (manufactured by Tokushu Kika Kogyo Co., Ltd.) at a number of revolutions of 2,000 $s^{-1}$. 68 parts by mass of a 1.0-mol/l aqueous solution of $CaCl_2$ were gradually added to the mixture to yield an aqueous medium containing a calcium phosphate salt.

In the meantime,

| | |
|---|---|
| Monomer styrene | 165 parts by mass |
| n-butyl acrylate | 35 parts by mass |
| Colorant C.I. Pigment Blue 15:3 | 15 parts by mass |
| were finely dispersed by a ball mill. Then, | |
| Polar resin saturated polyester resin (Tg 55° C., Mw 2.3 × $10^4$, Mn 3.5 × $10^3$) | 10 parts by mass |
| Releasing agent ester wax (highest endothermic peak 70° C., Mw 900, Mn 700) | 50 parts by mass |

were added to the resultant, and the whole was uniformly dissolved and dispersed by using a TK HOMOMIXER (manufactured by Tokushu Kika Kogyo Co., Ltd.) heated to 60° C. at 2,000 $s^{-1}$. 10 parts by mass of a polymerization initiator 2,2'-azobis(2,4-dimethylvaleronitrile) were dissolved into the resultant to prepare a polymerizable monomer composition.

The polymerizable monomer composition was fed into the aqueous medium, and the whole was stirred in a TK HOMOMIXER at 1,600 $s^{-1}$ for 10 min at 60° C. under an $N_2$ atmosphere, to thereby granulate the polymerizable monomer composition. After that, the temperature of the resultant was increased to 80° C. while the resultant was stirred by using a paddle stirring blade, to thereby allow the resultant to react for 10 hours. After the completion of the polymerization reaction, a remaining monomer was removed under reduced pressure. After the remainder had been cooled, hydrochloric acid was added to dissolve calcium phosphate. Then, the resultant was filtered, washed with water, and dried to produce toner particles.

Then, 1.0 part by mass of titanium oxide (T-1) surface-treated with isobutyl trimethoxysilane and having a primary average particle size of 55 nm and 1.0 part by mass of hydrophobic silica (Z-6) having a number average particle size and an aspect ratio shown in Table 1 were added to 100 parts by mass of the resultant toner particles, and the whole was mixed by using a HENSCHEL MIXER (FM-75, manufactured by Mitsui Miike Machinery Co., Ltd.) at a number of revolutions of 30 $s^{-1}$ for 10 min to produce toner (B-6). The resultant toner (B-6) had a weight average particle size of 8.3 μm, an average circularity of 0.975 and a UV transmittance of 12% when stirred and mixed in a 45% methanol solution.

Toner Production Example 7

Preparation of resin particle dispersion 1

| | |
|---|---|
| Styrene | 370 g |
| n-butyl acrylate | 30 g |
| Acrylic acid | 6 g |
| Dodecanethiol | 24 g |
| Carbon tetrabromide | 4 g |

The above materials were mixed and dissolved. In a flask, the resultant was dissolved and emulsified into 550 g of ion-exchanged water into which 6 g of a nonionic surfactant (NOBONYL, manufactured by SANYO KASEI COMPANY) and 10 g of an anionic surfactant (NEOGEN R, manufactured by DAI-ICHI KOGYO SEIYAKU CO., LTD.) were dissolved. 50 g of ion-exchanged water into which 4 g of ammonium persulfate were dissolved were charged into the resultant while the resultant was slowly mixed for 10 min, followed by substitution by nitrogen. Then, the contents in the flask were heated by using an oil bath up to 70° C. while the contents were stirred. Then, emulsion polymerization was continued for 5 hours without treatment. Thus, a resin particle dispersion 1 was prepared by dispersing the resin particle which had an average particle size of 150 nm, a glass transition point of 62° C., and a weight average molecular weight (Mw) of 12,000.

Preparation of resin particle dispersion 2

| | |
|---|---|
| Styrene | 280 g |
| n-butyl acrylate | 120 g |
| Acrylic acid | 8 g |

The above materials were mixed and dissolved. In a flask, the resultant was dissolved and emulsified into 550 g of ion-exchanged water into which 6 g of a nonionic surfactant and 12 g of an anionic surfactant were dissolved. 50 g of ion-exchanged water into which 3 g of ammonium persulfate were dissolved were charged into the resultant while the resultant was slowly mixed for 10 min, followed by substitution by nitrogen. Then, the contents in the flask were heated by using an oil bath up to 70° C. while the contents were stirred. Then, emulsion polymerization was continued for 5 hours without treatment. Thus, a resin particle dispersion 2 was prepared by dispersing the resin particle which had an average particle size of 110 nm, a glass transition point of 55° C., and a weight average molecular weight (Mw) of 550,000.

Preparation of Releasing Agent Particle Dispersion 1

| | |
|---|---|
| Polypropylene wax (highest endothermic peak 85° C., Mw 800, Mn 600) | 50 g |
| Anionic surfactant | 5 g |
| Ion-exchanged water | 200 g |

The above materials were heated to 95.° C. and dispersed by using a homogenizer or the like. Then, the resultant was subjected to dispersion treatment by using a pressure discharge type homogenizer to prepare a releasing agent particle dispersion 1 obtained by dispersing a releasing agent having an average particle size of 570 nm.

Preparation of Colorant Particle Dispersion 1

| | |
|---|---|
| C.I. Pigment Blue 15:3 | 20 g |
| Anionic surfactant | 2 g |
| Ion-exchanged water | 78 g |

The above materials were mixed, and the mixture was subjected to dispersion by using an ultrasonic cleaner at an oscillatory frequency of 26 kHz for 10 min to prepare a colorant particle dispersion (anionic) 1.

Preparation of Mixed Solution

| | |
|---|---|
| Resin particle dispersion 1 | 180 g |
| Resin particle dispersion 2 | 80 g |
| Colorant particle dispersion 1 | 30 g |
| Releasing agent particle dispersion 1 | 50 g |

The above materials were mixed in a round-bottom stainless flask by using a homogenizer and dispersed to prepare a mixed solution.

Formation of Agglomerate Particles 1.5 g of a cationic surfactant as an agglomerate reagent were added to the mixed solution, and the whole was heated by using an oil bath for heating up to 50° C. while the inside of the flask was stirred. After the temperature had been kept at 50° C. for 1 hour, observation with an optical microscope showed that agglomerate particles having a weight average particle size of about 6.1 μm were formed.

Fusion 3 g of an anionic surfactant were added to the stainless flask. After that, the stainless flask was hermetically sealed, and the mixture was heated up to 105° C. while stirring was continued by using a magnetic seal, and the mixture was kept at the temperature for 3 hours. Then, the mixture was cooled, and the reaction product was filtered, sufficiently washed with ion-exchanged water, and dried to produce toner particles.

Then, 1.0 part by mass of titanium oxide (T-1) surface-treated with isobutyl trimethoxysilane and having a primary average particle size of 55 nm and 1.0 part by mass of hydrophobic silica (Z-7) having a number average particle size and an aspect ratio shown in Table 1 were added to 100 parts by mass of the resultant toner particles, and the whole was mixed by using a HENSCHEL MIXER (FM-75, manufactured by Mitsui Miike Machinery Co., Ltd.) at a number of revolutions of 30 $s^{-1}$ for 10 min to produce toner (B-7) The resultant toner (B-7) had a weight average particle size of 6.2 μm, an average circularity of 0.965 and a UV transmittance of 21% when stirred and mixed in a 45% methanol solution.

Toner Production Example 8

Toner (b-1) was produced in the same manner as in Toner Production Example 1 except that: the hybrid resin was changed to the polyester resin described above; surface modification treatment was not performed; the titanium oxide (T-1) to be mixed with the resultant toner particles was changed to titanium oxide (T-2) surface-treated with isobutyl trimethoxysilane and having a primary average particle size of 75 nm; and the silica (Z-1) to be mixed therewith was changed to silica (Z-8) shown in Table 1. The resultant toner (b-1) had a weight average particle size of 4.3 μm, an average circularity of 0.901 and a UV transmittance of 82% when stirred and mixed in a 45% methanol solution.

Toner Production Example 9

Toner (b-2) was produced in the same manner as in Toner Production Example 6 except that: the granulation time of the polymerizable monomer composition was changed; the titanium oxide (T-1) to be mixed with the resultant toner particles was changed to the titanium oxide (T-2); and the silica (Z-1) to be mixed therewith was changed to silica (Z-9) shown in Table 1. The resultant toner (b-2) had a weight average particle size of 8.8 μm, an average circularity of 0.976 and a UV transmittance of 7% when stirred and mixed in a 45% methanol solution.

Toner Production Example 10

Toner (b-3) was produced in the same manner as in Toner Production Example 1 except that: the hybrid resin was changed to the polyester resin described above; surface modification treatment was not performed; and the silica (Z-1) to be mixed with the resultant toner particles was changed to silica (Z-8) shown in Table 1. The resultant toner (b-1) had a weight average particle size of 4.4 μm, an average circularity of 0.902 and a UV transmittance of 81% when stirred and mixed in a 45% methanol solution.

Production Example 1 of Magnetic Fine Particle-Dispersed Resin Carrier Core

A magnetic fine particle-dispersed resin carrier core (R-1) was produced by using the following materials.

| | |
|---|---|
| Phenol | 10 parts by mass |
| Formaldehyde solution (37-mass % aqueous solution) | 6 parts by mass |
| Magnetite particles (particle size 0.31 μm, $\sigma_{1000}$ = 60.2 $Am^2/kg$) | 76 parts by mass |
| Hematite particles (nonmagnetic, particle size 0.45 μm) | 8 parts by mass |

The above materials, 5 parts by mass of 28-mass % ammonia water, and 10 parts by mass of water were placed into a flask, and the whole was heated to 85° C. in 30 min while being stirred and mixed, and the whole was kept at the temperature and subjected to a polymerization reaction for 3 hours for curing. After that, the resultant was cooled to 30° C., and water was further added. After that, the supernatant was removed, and the precipitate was washed with water and dried with air. Next, the dried product was dried at a temperature of 60° C. under reduced pressure (5 hPa or less) to produce the magnetic fine particle-dispersed resin carrier core (R-1) into which magnetic fine particles were dispersed.

Production Example 2 of Magnetic Fine Particle-Dispersed Resin Carrier Core

A magnetic fine particle-dispersed resin carrier core (R-2) was produced by using the following materials.

| | |
|---|---|
| Phenol | 20 parts by mass |
| Formaldehyde solution (37-mass % aqueous solution) | 12 parts by mass |
| Magnetite particles (particle size0.32 μm, $\sigma_{1000}$ = 59.8 $Am^2/kg$) | 61 parts by mass |
| Hematite particles (nonmagnetic, particle size 0.44 μm) | 7 parts by mass |

The above materials, 10 parts by mass of 28-mass % ammonia water, and 10 parts by mass of water were placed into a flask, and the whole was heated to 85° C. in 30 min while being stirred and mixed, and the whole was kept at the temperature and subjected to a polymerization reaction for 3 hours for curing. After that, the resultant was cooled to 30° C., and water was further added. After that, the supernatant was removed, and the precipitate was washed with water and dried with air. Next, the dried product was dried at a temperature of 60° C. under reduced pressure (5 hPa or less) to produce the magnetic fine particle-dispersed resin carrier core (R-2) into which magnetic fine particles were dispersed.

Production Example 3 of Magnetic Fine Particle-Dispersed Resin Carrier Core

A magnetic fine particle-dispersed resin carrier core (R-3) was produced by using the following materials.

| | |
|---|---|
| Phenol | 10 parts by mass |
| Formaldehyde solution (37-mass % aqueous solution) | 6 parts by mass |
| Magnetite particles (particle size 0.31 μm, $\sigma_{1000}$ = 62.2 $Am^2/kg$) | 59 parts by mass |
| Hematite particles (nonmagnetic, particle size 0.45 μm) | 25 parts by mass |

The above materials, 5 parts by mass of 28-mass % ammonia water, and 10 parts by mass of water were placed into a flask, and the whole was heated to 85° C. in 30 min while being stirred and mixed, and the whole was kept at the temperature and subjected to a polymerization reaction for 3 hours for curing. After that, the resultant was cooled to 30° C., and water was further added. After that, the supernatant was removed, and the precipitate was washed with water and dried with air. Next, the dried product was dried at a temperature of 60° C. under reduced pressure (5 hPa or less) to produce the magnetic fine particle-dispersed resin carrier core (R-3) into which magnetic fine particles were dispersed.

Production Example 4 of Magnetic Fine Particle-Dispersed Resin Carrier Core

A magnetic fine particle-dispersed resin carrier core (R-4) was produced by using the following materials.

| | |
|---|---|
| Phenol | 30 parts by mass |
| Formaldehyde solution (37-mass % aqueous solution) | 18 parts by mass |
| Magnetite particles (particle size 0.33 μm, $\sigma_{1000}$ = 55.6 $Am^2/kg$) | 47 parts by mass |
| Hematite particles (nonmagnetic, particle size 0.46 μm) | 5 parts by mass |

The above materials, 15 parts by mass of 28-mass % ammonia water, and 10 parts by mass of water were placed into a flask, and the whole was heated to 85° C. in 30 min while being stirred and mixed, and the whole was kept at the temperature and subjected to a polymerization reaction for 3 hours for curing. After that, the resultant was cooled to 30° C., and water was further added. After that, the supernatant was removed, and the precipitate was washed with water and dried with air. Next, the dried product was dried at a temperature of 60° C. under reduced pressure (5 hPa or less) to produce the magnetic fine particle-dispersed resin carrier core (R-4) into which magnetic fine particles were dispersed.

Production Example 1 of Coating Material for Coating Layer 3 parts by mass of a methyl methacrylate macromonomer having an ethylenic unsaturated group at one end and a weight average molecular weight of 5,000, 46 parts by mass of a monomer using the following compound (G) as a unit, and 51 parts by mass of methyl methacrylate were added to a four-necked flask equipped with a reflux condenser, a thermometer, a nitrogen suction pipe, and a bedding type stirring device. Furthermore, 100 parts by mass of toluene, 100 parts by mass of methyl ethyl ketone, and 2.4 parts by mass of azobisisovaleronitrile were added, and the whole was kept at 80° C. for 10 hours in a stream of nitrogen to yield a graft copolymer solution (35mass % in solid content) Gel permeation chromatography (GPC) showed that the graft copolymer had a weight average molecular weight of 20,000.

(G)

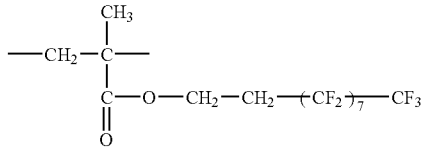

30 parts by mass of the resultant graft copolymer solution, 0.7 part by mass of a melamine resin (having a number average particle size of 0.25 μm), 1.2 parts by mass of carbon black (having a number average particle size of 35 nm and a DBP oil absorption of 50 ml/100 g), and 100 parts by mass of toluene were stirred with a homogenizer to produce a coating material (L-1).

Production Example 2 of Coating Material for Coating Layer 20 parts by mass of toluene, 20 parts by mass of butanol, 10 parts by mass of water, and 40 parts by mass of ice were placed into a four-necked flask, and the whole was stirred. During the stirring, 40 parts by mass of a mixture of $CH_3SiCl_3$ and $SiCl_2$ at a molar ratio of 3:2, and a catalyst were added, followed by stirring for an additional 30 min Then, the resultant was subjected to a condensation reaction at 60° C. for 1 hour. After that, siloxane was sufficiently washed with water, and was then dissolved into a mixed solvent of toluene-methyl ethyl ketone-butanol to prepare silicone varnish with a solid content of 10%.

The silicone varnish was added with 2.0 parts by mass of ion-exchanged water, 2.0 parts by mass of the following curing agent (h), and 2.0 parts by mass of an amino silane coupling agent $(CH_3)_2N—C_3H_6—Si—(OCH_3)_3$ with respect to 100 parts by mass of a siloxane solid content at one time to produce a coating material (L-2).

(h)

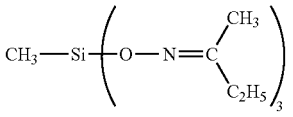

Production Example 1 of Magnetic Carrier 100 parts by mass of the magnetic fine particle-dispersed resin carrier core (R-1) were stirred while a shearing stress was continuously applied. During the stirring, the coating material (L-1) was gradually added to volatilize the solvent at 70° C., thereby coating the core surface with a resin. The resin-coated magnetic carrier particles were subjected to heat treatment at 100° C. for 2 hours while being stirred, followed by shredding. Then, the resultant was classified by using a sieve having an aperture of 76 μm to produce a magnetic carrier (C-1) having a number average particle size of 35 μm, a specific resistance of $5.9\times10^9$ Ω·cm, a true specific gravity of 3.6 g/cm$^3$, an intensity of magnetization (σ1000) of 50.6 Am$^2$/kg, and a remnant magnetization of 4.8 Am$^2$/kg. Table 2 shows the physical properties of the resultant magnetic carrier.

Production Example 2 of Magnetic Carrier

A magnetic carrier (C-2) was produced in the same manner as in Production Example 1 of Magnetic Carrier except that Cu—Zn ferrite particles (particle size 41 μm, $\sigma_{1000}$=69.0 Am$^2$/kg) were used instead of the magnetic fine particle-dispersed resin carrier core (R-1). Table 2 shows the physical properties of the resultant magnetic carrier.

Production Example 3 of Magnetic Carrier

A magnetic carrier (C-3) was produced in the same manner as in Production Example 1 of Magnetic Carrier except that the magnetic fine particle-dispersed resin carrier core (R-2) was used instead of the magnetic fine particle-dispersed resin carrier core (R-1) Table 2 shows the physical properties of the resultant magnetic carrier.

Production Example 4 of Magnetic Carrier

A magnetic carrier (C-4) was produced in the same manner as in Production Example 1 of Magnetic Carrier except that the magnetic fine particle-dispersed resin carrier core (R-3) was used instead of the magnetic fine particle-dispersed resin carrier core (R-1). Table 2 shows the physical properties of the resultant magnetic carrier.

Production Example 5 of Magnetic Carrier

A magnetic carrier (C-5) was produced in the same manner as in Production Example 1 of Magnetic Carrier except that the coating material for a coating layer (L-2) was used instead of the coating material for a coating layer (L-1). Table 2 shows the physical properties of the resultant magnetic carrier.

Production Example 6 of Magnetic Carrier

A magnetic carrier (C-6) was produced in the same manner as in Production Example 1 of Magnetic Carrier except that Mg—Mn ferrite particles (particle size 32 μm, $\sigma_{1000}$=63.1 Am$^2$/kg) were used instead of the magnetic fine particle-dispersed resin carrier core (R-1). Table 2 shows the physical properties of the resultant magnetic carrier.

Production Example 7 of Magnetic Carrier

A magnetic carrier (c-1) was produced in the same manner as in Production Example 1 of Magnetic Carrier except that the magnetic fine particle-dispersed resin carrier core (R-4) was used instead of the magnetic fine particle-dispersed resin carrier core (R-1). Table 2 shows the physical properties of the resultant magnetic carrier.

Production Example 8 of Magnetic Carrier

A magnetic carrier (c-2) was produced in the same manner as in Production Example 1 of Magnetic Carrier except that magnetite particles (particle size 17 μm, $\sigma_{1000}$=74.2 Am$^2$/kg) were used instead of the magnetic fine particle-dispersed resin carrier core (R-1). Table 2 shows the physical properties of the resultant magnetic carrier.

Developer Production Example 1

8 parts by mass of the toner (B-1) were added to 92 parts by mass of the magnetic carrier (C-1), and the whole was mixed by using a Turbula mixer to produce a two-component developer (D-1) having a degree of compression C of 26% and a shearing stress under a consolidation load of $4.0\times10^{-4}$ N/mm$^2$ of $1.6\times10^{-4}$ N/mm$^2$. Table 3 shows the physical properties of the resultant developer.

Developer Production Examples 2 to 13

Each of two-component developers (D-2) to (D-10) and two-component developers (d-1) to (d-3) was produced in the same manner as in Developer Production Example 1 except that a magnetic carrier and toner were mixed in a combination shown in Table 3. Table 3 shows the physical properties of the resultant developers.

Example 1

A full-color copying machine CLC5000 manufactured by Canon Inc. was reconstructed as follows. First, a laser spot diameter was narrowed down so as to be able to output at 600 dpi. Second, as shown in FIG. 1, the number of developing sleeves in a developing unit was changed to two: a developing sleeve on an upstream side (having a diameter of 20 mm) and a developing sleeve on a downstream side (having a diameter of 16 mm) each of which was opposed to the photosensitive drum. Third, the surface layer of a fixing roller in a fixing unit was changed to a PFA tube and an oil applying mechanism was removed. By using the two-component developer (D-1) and the reconstructed machine, image output and evaluation were performed under a normal-temperature-and-normal-humidity environment (N/N; 23° C., 50% RH), a normal-temperature-and-low-humidity environment (N/L; 23° C., 5% RH); and a high-temperature-and-high-humidity environment (H/H; 30° C., 80% RH) while the toner (B-1) was replenished. The developing conditions were as follows. Each developing sleeve and the photosensitive member were allowed to rotate in a developing region in a forward direction. The peripheral speed of the developing sleeve was set to be 1.6 times as high as that of the photosensitive member. The developing bias had a Vd of −650 V, Vl of −150 V, Vpp of 2.0 kV, and a frequency of 1.8 kHz. Evaluation items and evaluation criteria are shown below. Table 4 shows the results of the evaluation.

[Evaluation Items]

(Solid Uniformity)

A 30H image was formed by using the developer and the reconstructed machine. The image was observed with the eyes, and was evaluated for reproducibility of solid uniformity in accordance with following indices. The value "30H" in the 30H image is a value when 256 gray levels are represented in hexadecimal notation. That is, the 30H image is a halftone image having the 49th gray level in the 256 gray levels counted from a solid white image.

A: An image having entirely neither stripe nor unevenness, and having no graininess.

B: An image having neither stripe nor unevenness, but having slight graininess.

C: An image having a slight stripe and slight unevenness, and having graininess.

D: An image having many stripes and much unevenness, and having strong graininess.

E: An image having remarkable stripes and remarkable unevenness.

(Image Density)

The density of a fixed image obtained by fixing the solid image at 180° C. was measured by using a densitometer X-RITE 500. The average of 6 points was defined as the image density.

(Q/M On Developing Sleeve After 10,000)

10,000 images were output from the reconstructed machine by using the two-component developer. Then, the developer on each developing sleeve was sampled, and a charge amount per unit mass Q/M (mC/kg) of toner on each developing sleeve was measured by using an E-SPART ANALYZER (manufactured by Hosokawa Micron Corporation) equipped with a two-component feeder and was defined as a Q/M on a sleeve after 10,000.

(Scattering of Developer)

The two-component developer was charged into the reconstructed developing unit, and a developing sleeve was subjected to idle rotation for 1 hour at a peripheral speed of 600 mm/sec under each environment. At that time, the developer that had scattered from the sleeve surface was collected, observed with the eyes, and evaluated for scattering in accordance with the following criteria.

A: No developer scatters.

B: A slight amount of toner out of a developer scatters.

C: A large amount of toner scatters, but no carrier scatters.

D: Not only toner but also a little carrier scatters.

E: Scattering of a developer is remarkable.

(Toner Spent)

The two-component developer was charged into the reconstructed developing unit, and a developing sleeve was subjected to idle rotation for 1 hour at a process speed of 600 mm/s under each environment. Then, the developer was sampled from the sleeve surface, and toner and a carrier were separated. While the carrier surface after the idle rotation was observed with a scanning electron microscope (SEM), a halftone image was output and evaluated for toner spent in accordance with the following criteria.

A: Nearly no toner adheres to the carrier surface.

B: A slight amount of toner adheres to the carrier surface.

C: Toner spent occurs, but no scumming occurs.

D: Toner spent occurs, and slight scumming is observed.

E: Toner spent occurs, and scumming is remarkable.

Examples 2 to 10

Image output and evaluation were performed in the same manner as in Example 1 except that: the two-component developer (D-1) was changed to any one of the two-component developers (D-2) to (D-10); and toner corresponding to each two-component developer shown in Table 3 was replenished. Table 4 shows the results of the evaluation.

Comparative Examples 1 to 3

Image output and evaluation were performed in the same manner as in Example 1 except that: the two-component developer (D-1) was changed to any one of the two-component developers (d-1) to (d-3); and toner corresponding to each two-component developer shown in Table 3 was replenished. Table 4 shows the results of the evaluation.

Production Example 1 of Developer for Replenishment 90 parts by mass of the toner (B-1) were added to 10 parts by mass of the magnetic carrier (C-1) and the whole was mixed by using a Turbula mixer to produce a developer for replenishment (D-1)' for the two-component developer (D-1) as a developer for replenishment of the two-component developer (D-1).

Production Examples of other Developers for Replenishment

Developers for replenishment (D-9)', (D-10)', (d-1)', and (d-2)' were prepared in the same manner as in Production Example 1 of Developer for Replenishment except that toner and magnetic carriers used for producing the two-component developers (D-9), (D-10), (d-1), and (d-2) were used.

Example 11

Image output and evaluation were performed in the same manner as in Example 1 except the following. First, the developing unit was further reconstructed. That is, the developing unit was divided into a developing chamber for supplying a developer to a developer sleeve on an upstream side and a stirring chamber for collecting a developer passing through a developing region. Each of the developing chamber and the stirring chamber had a screw for circulating the developer. A magnet roll having a magnetic pole structure as shown in FIG. 2 was incorporated into each developing sleeve. A developer layer thickness regulating member was brought close to the developing sleeve on an upstream side as shown in FIG. 2. Further, a replenishment port (not shown) for supplying a developer for replenishment and a discharge port (not shown) for discharging an excessive developer were provided. Second, image output and evaluation were performed while the developer for replenishment (D-1)' was replenished. Table 5 shows the results of the evaluation.

Examples 12 and 13 and Comparative Examples 4 and 5

Image output and evaluation were performed in the same manner as in Example 11 except that: the two-component developer (D-1) was changed to any one of the two-component developers (D-9), (D-10), (d-1), and (d-2); and the developer for replenishment was changed to any one of the developers for replenishment (D-9)', (D-10)', (d-1)', and (d-2)'. Table 5 shows the results of the evaluation.

TABLE 1

| | | | | | Hydrophobic silica | | | | | | Particle size distribution | | |
|---|---|---|---|---|---|---|---|---|---|---|---|---|---|
| | Binder resin | Colorant | Wax | Titanium Oxide | Kind | Treatment | Particle size (μm) | Aspect ratio | Condition for external addition (stirring time) (min) | UV transmittance in 45% methanol solution (%) | Weight average particle size (μm) | Content of particles each having a size of 4.0 μm or less (number %) | Average circularity |
| Toner (B-1) | Hybrid | C. I. Pig. Blue 15:3 | Paraffin Wax | T-1 | Z-1 | HMDS | 0.14 | 1.08 | 10 | 45 | 6.5 | 18.6 | 0.942 |
| Toner (B-2) | Hybrid | C. I. Pig. Blue 15:3 | Paraffin Wax | T-1 | Z-2 | HMDS | 0.07 | 1.01 | 8 | 32 | 6.7 | 17.8 | 0.932 |
| Toner (B-3) | Hybrid | C. I. Pig. Blue 15:3 | Paraffin Wax | T-1 | Z-3 | HMDS | 0.16 | 1.06 | 10 | 62 | 6.3 | 20.1 | 0.955 |
| Toner (B-4) | Hybrid | C. I. Pig. Blue 15:3 | Paraffin Wax | T-1 | Z-4 | HMDS | 0.28 | 1.20 | 20 | 71 | 6.6 | 18.7 | 0.956 |
| Toner (B-5) | Polyester | C. I. Pig. Blue 15:3 | Paraffin Wax | T-1 | Z-5 | HMDS | 0.22 | 1.21 | 10 | 79 | 4.6 | 35.0 | 0.940 |
| Toner (B-6) | St-nBA resin | C. I. Pig. Blue 15:3 | Ester Wax | T-1 | Z-6 | HMDS dimethyl silicon | 0.25 | 1.43 | 10 | 12 | 8.3 | 5.8 | 0.975 |
| Toner (B-7) | St-nBA resin | C. I. Pig. Blue 15:3 | Polypropylene Wax | T-1 | Z-7 | HMDS | 0.12 | 1.48 | 10 | 21 | 6.2 | 28.3 | 0.965 |
| Toner (b-1) | Polyester | C. I. Pig. Blue 15:3 | Paraffin Wax | T-2 | Z-8 | HMDS | 0.05 | 1.51 | 10 | 82 | 4.3 | 42.3 | 0.901 |
| Toner (b-2) | St-nBA resin | C. I. Pig. Blue 15:3 | Ester Wax | T-2 | Z-9 | HMDS | 0.32 | 1.55 | 10 | 7 | 8.8 | 4.7 | 0.976 |
| Toner (b-3) | Polyester | C. I. Pig. Blue 15:3 | Paraffin Wax | T-1 | Z-8 | HMDS | 0.05 | 1.51 | 10 | 81 | 4.4 | 40.7 | 0.902 |

TABLE 2

| | List of carriers | | | | | Magnetic properties | |
|---|---|---|---|---|---|---|---|
| | Core material | Coating material | Number average particle size (μm) | Specific resistance (Ω ?cm) | True density (g/cm$^3$) | Intensity of magnetization σ1000 (Am$^2$/kg) | Remnant magnetization σr (Am2/kg) |
| Carrier (C-1) | Resin core (R-1) | Coat (L-1) | 35 | $5.9 \times 10^9$ | 3.6 | 50.6 | 4.8 |
| Carrier (C-2) | Cu-Zn Ferrite | Coat (L-1) | 42 | $2.1 \times 10^7$ | 4.8 | 68.6 | 2.7 |
| Carrier (C-3) | Resin core (R-2) | Coat (L-1) | 36 | $5.7 \times 10^{10}$ | 3.2 | 46.6 | 4.3 |
| Carrier (C-4) | Resin core (R-3) | Coat (L-1) | 37 | $8.9 \times 10^{10}$ | 3.4 | 42.1 | 3.4 |
| Carrier (C-5) | Resin core (R-1) | Coat (L-2) | 36 | $3.6 \times 10^{11}$ | 3.5 | 50.8 | 4.8 |
| Carrier (C-6) | Mg-Mn Ferrite | Coat (L-1) | 33 | $6.2 \times 10^7$ | 2.7 | 62.3 | 2.2 |
| Carrier (c-1) | Resin core (R-4) | Coat (L-1) | 46 | $4.8 \times 10^{12}$ | 2.2 | 37.6 | 1.7 |
| Carrier (c-2) | Magnetite | Coat (L-1) | 19 | $9.2 \times 10^6$ | 5.8 | 73.5 | 12.0 |

TABLE 3

| Developer | Toner | Carrier | Degree of compaction C (%) | Shearing stress ($N/mm^2$) |
|---|---|---|---|---|
| Developer (D-1) | (B-1) | (C-1) | 26 | $1.6 \times 10^{-4}$ |
| Developer (D-2) | (B-2) | (C-1) | 24 | $1.3 \times 10^{-4}$ |
| Developer (D-3) | (B-3) | (C-1) | 25 | $1.4 \times 10^{-4}$ |
| Developer (D-4) | (B-4) | (C-3) | 22 | $1.8 \times 10^{-4}$ |
| Developer (D-5) | (B-5) | (C-4) | 26 | $2.1 \times 10^{-4}$ |
| Developer (D-6) | (B-6) | (C-2) | 30 | $0.9 \times 10^{-4}$ |
| Developer (D-7) | (B-7) | (C-6) | 21 | $2.4 \times 10^{-4}$ |

TABLE 3-continued

| Developer | Toner | Carrier | Degree of compaction C (%) | Shearing stress ($N/mm^2$) |
|---|---|---|---|---|
| Developer (D-8) | (B-1) | (C-5) | 25 | $1.8 \times 10^{-4}$ |
| Developer (D-9) | (B-5) | (C-2) | 32 | $2.5 \times 10^{-4}$ |
| Developer (D-10) | (B-6) | (C-6) | 20 | $0.7 \times 10^{-4}$ |
| Developer (d-1) | (b-1) | (c-2) | 38 | $2.7 \times 10^{-4}$ |
| Developer (d-2) | (b-2) | (c-1) | 12 | $0.6 \times 10^{-4}$ |
| Developer (d-3) | (b-3) | (c-2) | 36 | $2.6 \times 10^{-4}$ |

TABLE 4

| | | | Results of evaluation (twin SLV) | | | | | | | |
|---|---|---|---|---|---|---|---|---|---|---|
| | | | Solid uniformity | | Image density | | Q/M on SLV after 10k | | Scattering of | Toner |
| Example | Developer | Environment | INI | 10k | INI | 10k | Upstream SLV | Downstream SLV | developer | spent |
| Example 1 | (D-1) | N/N | A | B | 1.51 | 1.48 | −30.2 | −28.6 | A | B |
| | | N/L | A | A | 1.56 | 1.54 | −36.2 | −35.2 | A | A |
| | | H/H | B | B | 1.46 | 1.43 | −23.4 | −21.4 | A | B |
| Example 2 | (D-2) | N/N | A | B | 1.50 | 1.47 | −29.6 | −27.6 | A | B |
| | | N/L | B | B | 1.55 | 1.52 | −34.7 | −32.5 | B | A |
| | | H/H | B | B | 1.44 | 1.40 | −21.5 | −20.1 | A | B |
| Example 3 | (D-3) | N/N | A | B | 1.52 | 1.48 | −31.1 | −29.3 | A | B |
| | | N/L | A | B | 1.57 | 1.55 | −37.1 | −36.1 | B | A |
| | | H/H | B | B | 1.47 | 1.44 | −24.5 | −22.6 | A | B |
| Example 4 | (D-4) | N/N | B | B | 1.49 | 1.46 | −28.2 | −26.1 | A | B |
| | | N/L | A | B | 1.53 | 1.50 | −34.3 | −32.1 | A | B |
| | | H/H | B | C | 1.42 | 1.39 | −21.2 | −18.9 | A | B |
| Example 5 | (D-5) | N/N | B | C | 1.44 | 1.39 | −26.7 | −23.6 | B | C |
| | | N/L | B | B | 1.50 | 1.46 | −30.5 | −28.6 | B | C |
| | | H/H | B | C | 1.40 | 1.36 | −20.7 | −16.9 | B | C |
| Example 6 | (D-6) | N/N | B | B | 1.46 | 1.43 | −25.6 | −21.5 | B | B |
| | | N/L | B | B | 1.51 | 1.47 | −31.0 | −26.5 | C | B |
| | | H/H | B | C | 1.41 | 1.37 | −21.0 | −17.3 | B | C |
| Example 7 | (D-7) | N/N | B | C | 1.39 | 1.35 | −24.5 | −19.5 | B | C |
| | | N/L | B | B | 1.45 | 1.41 | −28.9 | −25.6 | C | C |
| | | H/H | C | C | 1.34 | 1.30 | −19.7 | −16.3 | B | C |
| Example 8 | (D-8) | N/N | B | B | 1.49 | 1.45 | −29.3 | −25.7 | B | C |
| | | N/L | A | B | 1.53 | 1.48 | −33.5 | −28.3 | B | B |
| | | H/H | B | C | 1.43 | 1.38 | −20.5 | −17.3 | B | C |
| Example 9 | (D-9) | N/N | C | C | 1.36 | 1.32 | −19.6 | −16.3 | B | C |
| | | N/L | B | C | 1.41 | 1.37 | −24.5 | −19.9 | B | C |
| | | H/H | C | D | 1.31 | 1.26 | −14.7 | −10.5 | B | D |
| Example 10 | (D-10) | N/N | B | C | 1.41 | 1.36 | −21.5 | −18.6 | C | B |
| | | N/L | C | C | 1.39 | 1.35 | −19.8 | −17.6 | D | B |
| | | H/H | B | C | 1.40 | 1.34 | −20.5 | −16.5 | B | C |
| Comparative example 1 | (d-1) | N/N | D | D | 1.25 | 1.20 | −11.5 | −8.8 | B | D |
| | | N/L | C | D | 1.31 | 1.26 | −13.6 | −10.8 | B | D |
| | | H/H | D | E | 1.20 | 1.14 | −8.6 | −6.2 | B | E |
| Comparative example 2 | (d-2) | N/N | D | D | 1.25 | 1.20 | −12.1 | −10.0 | D | B |
| | | N/L | D | E | 1.21 | 1.11 | −10.7 | −7.1 | E | B |
| | | H/H | C | D | 1.30 | 1.25 | −13.3 | −10.3 | C | B |
| Comparative example 3 | (d-3) | N/N | D | D | 1.26 | 1.22 | −12.7 | −9.9 | B | D |
| | | N/L | C | D | 1.32 | 1.28 | −14.8 | −11.2 | B | D |
| | | H/H | D | D | 1.22 | 1.16 | −9.8 | −8.1 | B | D |

TABLE 5

Results of evaluation (twin SLV + vertical stirring + light compression + ACR)

| Example | Developer | Environment | Solid uniformity INI | Solid uniformity 10k | Image density INI | Image density 10k | Q/M on SLV after duration Upstream SLV | Q/M on SLV after duration Downstream SLV | Scattering of developer | Toner spent |
|---|---|---|---|---|---|---|---|---|---|---|
| Example 11 | (D-1) | N/N | A | A | 1.53 | 1.50 | −34.5 | −33.6 | A | A |
| | | N/L | A | A | 1.57 | 1.55 | −38.4 | −37.6 | A | A |
| | | H/H | A | B | 1.50 | 1.46 | −30.5 | −28.6 | A | B |
| Example 12 | (D-9) | N/N | A | B | 1.50 | 1.47 | −31.5 | −28.0 | A | B |
| | | N/L | A | A | 1.54 | 1.50 | −34.5 | −30.0 | A | B |
| | | H/H | B | C | 1.45 | 1.40 | −27.9 | −25.6 | A | C |
| Example 13 | (D-10) | N/N | A | A | 1.51 | 1.48 | −30.4 | −28.6 | B | A |
| | | N/L | B | C | 1.48 | 1.45 | −25.4 | −21.4 | C | A |
| | | H/H | A | A | 1.45 | 1.41 | −26.5 | −24.3 | A | B |
| Comparative example 4 | (d-1) | N/N | D | E | 1.26 | 1.18 | −11.8 | −6.9 | B | E |
| | | N/L | C | D | 1.32 | 1.26 | −14.1 | −10.8 | B | D |
| | | H/H | D | E | 1.21 | 1.14 | −9.2 | −5.9 | B | E |
| Comparative example 5 | (d-2) | N/N | D | D | 1.27 | 1.21 | −12.3 | −10.1 | E | B |
| | | N/L | D | E | 1.22 | 1.09 | −11.8 | −6.5 | E | B |
| | | H/H | C | D | 1.31 | 1.26 | −13.5 | −10.1 | D | B |

This application claims the right of priority under 35 U.S.C. §119 based on Japanese Patent Application No. JP 2004-131124 filed Apr. 27, 2004 which is hereby incorporated by reference herein in their entirety as if fully set forth herein.

What is claimed is:

1. A developing method using a developing device including:

a first developer bearing member arranged to be opposed to an image bearing member; a developer layer thickness regulating member for forming a developer layer on the first developer bearing member; and a second developer bearing member arranged on a downstream side of a rotation direction of the image bearing member with respect to the first developer bearing member, the developing method comprising the steps of:

causing the first developer bearing member and the second developer bearing member to carry and convey a developer to a developing region where one of the first developer bearing member and the second developer bearing member, and the image bearing member are opposed to each other; and developing a latent image formed on the image bearing member with the developer, wherein:

the developing device has a structure in which a developer supplied to a developing region formed by the first developer bearing member and the image bearing member is transported from the first developer bearing member to the second developer bearing member, and the transported developer is supplied to a developing region formed by the second developer bearing member and the image bearing member;

the developer comprises a two-component developer having: toner having toner particles each containing at least a binder resin and a colorant; and a magnetic carrier;

the developer has a degree of compression C(%) determined from the following equation in a range of 20 to 32%:

$$\text{Degree of compression } C(\%)=100\times(P-A)/P$$

where A represents an aerated bulk density (g/cm$^3$) and P represents a packed bulk density; (g/cm$^3$), and a shearing stress of the developer obtained by shearing stress measurement under a consolidation load of $4.0\times10^{-4}$ N/mm$^2$ is in a range of $0.5\times10^{-4}$ to $2.5\times10^{-4}$ N/mm$^2$.

2. A developing method according to claim 1, wherein the magnetic carrier comprises a carrier having a coating layer on a surface of a magnetic fine particle-dispersed resin core containing at least a magnetic fine particle and a binder resin.

3. A developing method according to claim 1, wherein the toner has toner particles externally added with inorganic fine particles, and the inorganic fine particles have an aspect ratio (a major axis/a minor axis) at a toner particle surface in a range of 1.0 to 1.5 and have a number average particle size at the toner particle surface in a range of 0.06 to 0.30 μm.

4. A developing method according to claim 1, wherein the developing device has a developing chamber for supplying a developer to the first developer bearing member and a stirring chamber for collecting a developer from the second developer bearing member, the stirring chamber being arranged below the developing chamber, and the collected developer is lifted and transported from the stirring chamber to the developing chamber by a pressure of the developer at an end portion of the stirring chamber.

5. A developing method according to claim 1, wherein:

the first developer bearing member includes first magnetic field generating means which is arranged so as not to rotate and a first developing sleeve which includes the first magnetic field generating means therein and is arranged to be capable of rotating;

the first magnetic field generating means includes a first magnetic pole arranged in a moving direction of the first developer bearing member and on a downstream side of the developing region and a second magnetic pole arranged in the same moving direction so as to be adjacent to a downstream side of the first magnetic pole and having the same polarity as that of the first magnetic pole;

the developer layer thickness regulating member is arranged in a region substantially opposed to the second magnetic pole;

the second developer bearing member includes second magnetic field generating means which is arranged so as not to rotate and a second developing sleeve which includes the second magnetic field generating means therein and is arranged to be capable of rotating; and the second magnetic field generating means includes a third magnetic pole arranged in a region substantially opposed to the first magnetic pole and having a polarity opposite to that of the first magnetic pole and a fourth magnetic pole arranged to be adjacent to an upstream side of a rotation direction of the second developer bearing member with respect to the third magnetic pole and having the same polarity as that of the third magnetic pole.

6. A developing method according to claim 1, wherein the developing device includes a developer discharging mechanism, wherein the developer discharging mechanism discharges an excessive developer, and the developing device is replenished with a developer for replenishment containing at least the toner and the magnetic carrier.

7. A developing device comprising:

a first developer bearing member arranged to be opposed to an image bearing member;

a developer layer thickness regulating member for forming a developer layer on the first developer bearing member; and a second developer bearing member arranged on a downstream side of a rotation direction of the image bearing member with respect to the first developer bearing member, the developing device causing the first developer bearing member and the second developer bearing member to carry and convey a developer to a developing region where one of the first developer bearing member and the second developer bearing member, and the image bearing member are opposed to each other, the developing device developing a latent image formed on the image bearing member with the developer, wherein:

the developing device includes a structure in which a developer supplied to a developing region formed by the first developer bearing member and the image bearing member is transported from the first developer bearing member to the second developer bearing member, and the transported developer is supplied to a developing region formed by the second developer bearing member and the image bearing member;

the developer comprises a two-component developer having: toner having toner particles each containing at least a binder resin and a colorant; and a magnetic carrier;

the developer has a degree of compression C(%) determined from the following equation in a range of 20 to 32%:

$$\text{Degree of compression } C(\%)=100\times(P-A)/P$$

where A represents an aerated bulk density ($g/cm^3$) and P represents a packed bulk density ($g/cm^3$), and a shearing stress by shearing stress measurement under a consolidation load of $4.0\times10^{-4}$ $N/mm^2$ in the range of $0.5\times10^{-4}$ to $2.5\times10^{-4}$ $N/mm^2$.

* * * * *

UNITED STATES PATENT AND TRADEMARK OFFICE

CERTIFICATE OF CORRECTION

PATENT NO. : 7,272,348 B2
APPLICATION NO. : 11/114080
DATED : September 18, 2007
INVENTOR(S) : Naoki Okamoto et al.

It is certified that error appears in the above-identified patent and that said Letters Patent is hereby corrected as shown below:

ON THE TITLE PAGE:

At Item (56), References Cited, Foreign Patent Documents, Page 2, "11073005 A" should read --11-073005 A-- and "2003323052 A" should read --2003-323052 A--.

COLUMN 1:

Line 53, "carries" should read --carriers--; and
Line 54, "sleeves)" should read --sleeves).--.

COLUMN 5:

Line 34, "thorough" should read --through--.

COLUMN 6:

Line 12, "U2" should be deleted.

COLUMN 9:

Line 64, "material" should read --material.--.

COLUMN 12:

Line 63, "binder-resin" should read --binder resin--.

COLUMN 13:

Line 65, "1,2,3,6-hexaenetetrol" should read --1,2,3,6-hexanetetrol;--.

COLUMN 15:

Line 48, "2-hydorypropyl" should read --2-hydroxypropyl.--.

COLUMN 16:

Line 13, "tell" should read --te--;
Line 51, "perxoxide," should read --peroxide--;
Line 52, "isopropylperoxydicarbonte;" should read --isopropylperoxydicarbonate;--;
Line 53, "bonte" should read --bonate--; and "di-n-propylperoxydicarbonte;" should read --di-n-propylperoxydicarbonate;--;
Line 54, "ethoxyethylperoxycarbonte;" should read --ethoxyethylperoxycarbonate--;
Line 55, "di-methoxyisopropylperoxycarbonte;" should read --di-methoxyisopropylperoxycarbonate--;
Line 56, "peroxydicarbonte;" should read --peroxydicarbonate;-- and "aceatyl" should read --acetyl--.

UNITED STATES PATENT AND TRADEMARK OFFICE

CERTIFICATE OF CORRECTION

PATENT NO. : 7,272,348 B2
APPLICATION NO. : 11/114080
DATED : September 18, 2007
INVENTOR(S) : Naoki Okamoto et al.

It is certified that error appears in the above-identified patent and that said Letters Patent is hereby corrected as shown below:

COLUMN 18:

Line 59, "(using a" should read --(using an--.

COLUMN 19:

Line 6, "65 to" should read --65 to 110°C.--; and

Line 45, "phtalimidemethyl" should read --phthalimidemethyl--.

Lines 49 through 61

"

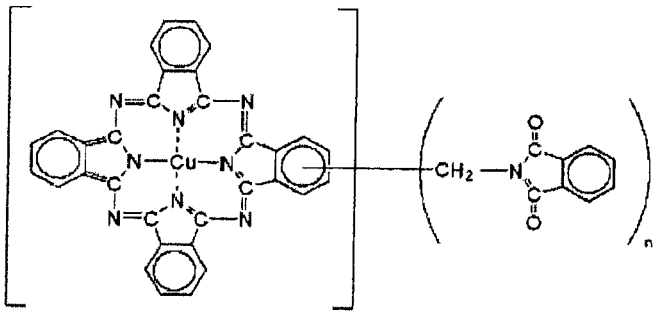

"

should read

--

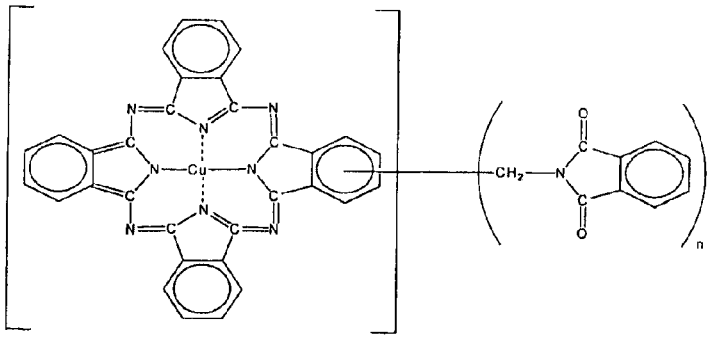

--.

COLUMN 20:

Line 17, "masterbatchd," should read --masterbatched,--.

COLUMN 22:

Line 21, "powder" should read --powder.--.

COLUMN 25:

Line 26, "transfer, agent," should read --transfer agent,--.

UNITED STATES PATENT AND TRADEMARK OFFICE

CERTIFICATE OF CORRECTION

PATENT NO. : 7,272,348 B2
APPLICATION NO. : 11/114080
DATED : September 18, 2007
INVENTOR(S) : Naoki Okamoto et al.

It is certified that error appears in the above-identified patent and that said Letters Patent is hereby corrected as shown below:

COLUMN 27:
Line 18, “a” should read --an--; and
Line 25, “(100 ml)” should read --(100 ml).--.

COLUMN 28:
Line 63, “follows” should read --follows.--.

COLUMN 29:
Line 7, “form” should read --from--; and
Line 57, “follow.” should read --follows.--

COLUMN 30:
Line 25, “512x512)” should read --512x512).--.

COLUMN 31:
Line 10, “device” should read --device.--; and
Line 48, “(heldat” should read --(held at--.

COLUMN 32:
Line 6, “in” should read --inorganic--;
Line 7, “organic” should be deleted;
Line 18, “500or” should read --500 or--; and
Line 25, “size” should read --size.--.

COLUMN 34:
Line 21, “used” should read --using--; and
Line 50, “(B-1)” should read --(B-1).--.

COLUMN 38:
Line 8, “produce toner (B-7)” should read --produce toner (B-7).--.

COLUMN 40:
Line 42, “content)” should read --content).--.

COLUMN 41:
Line 4, “min” should read --min.--; and
Line 59, “(R-1) should read --(R-1).--.

COLUMN 46:
Table 1, “4.6” should read --4.5--; and
Table 2, “(Am2/kg)” should read --($Am^2$/kg)--.

UNITED STATES PATENT AND TRADEMARK OFFICE

CERTIFICATE OF CORRECTION

PATENT NO. : 7,272,348 B2
APPLICATION NO. : 11/114080
DATED : September 18, 2007
INVENTOR(S) : Naoki Okamoto et al.

It is certified that error appears in the above-identified patent and that said Letters Patent is hereby corrected as shown below:

COLUMN 48:
Table 4, "-9.8" should read --9.6--.

COLUMN 49:
Line 67, "density;" should read --density--.

COLUMN 52:
Line 27, "a shearing stress" should read --a shearing stress of the developer obtained--; and
Line 28, "the" should read --a--.

Signed and Sealed this

Fifteenth Day of July, 2008

JON W. DUDAS
*Director of the United States Patent and Trademark Office*